US009767773B2

(12) United States Patent
Bedson

(10) Patent No.: US 9,767,773 B2
(45) Date of Patent: Sep. 19, 2017

(54) DRUMHEAD TUNING RIM SYSTEM AND METHOD OF USE

(71) Applicant: Bedson Drum Co., Seattle, WA (US)

(72) Inventor: Bryan Thomas Bedson, Costa Mesa, CA (US)

(73) Assignee: Bedson Drum Co., Seattle, WA (US)

( * ) Notice: Subject to any disclaimer, the term of this patent is extended or adjusted under 35 U.S.C. 154(b) by 0 days.

(21) Appl. No.: 15/136,693

(22) Filed: Apr. 22, 2016

(65) Prior Publication Data

US 2016/0240175 A1 Aug. 18, 2016

Related U.S. Application Data

(63) Continuation-in-part of application No. 14/576,186, filed on Dec. 18, 2014, now Pat. No. 9,653,052, which is a continuation-in-part of application No. 14/383,510, filed as application No. PCT/US2014/010532 on Jan. 7, 2014, now Pat. No. 9,006,548, which is a continuation of application No. 13/740,148, filed on Jan. 11, 2013, now Pat. No. 8,642,867.

(51) Int. Cl.
*G10D 13/02* (2006.01)

(52) U.S. Cl.
CPC ..... *G10D 13/023* (2013.01); *Y10T 29/49574* (2015.01)

(58) Field of Classification Search
CPC ..... G10D 13/023
See application file for complete search history.

(56) References Cited

U.S. PATENT DOCUMENTS 19,602 A * 3/1858 Zimmermann ..... G10D 13/023 84/413
223,586 A * 1/1880 Fayaux ..... G10D 13/023 24/457
795,034 A * 7/1905 Harris ..... G10D 13/023 84/413

(Continued)

FOREIGN PATENT DOCUMENTS

AT 388463 B 11/1988
CH 274881 A 4/1951

OTHER PUBLICATIONS

International Search Report and the Written Opinion of the International Searching Authority PCT/US2014/010532 dated Aug. 22, 2014.

(Continued)

*Primary Examiner* — Robert W Horn
(74) *Attorney, Agent, or Firm* — Lodestone Legal Group; Jeromye V. Sartain

(57) ABSTRACT

A drumhead tuning rim system and method for securing and tuning a drumhead on a drum shell of a drum, comprising a drumhead tuning rim apparatus comprising a cable tension dial assembly configured for operably engaging a rim of the drum so as to increase or decrease tension on the rim, the rim being configured for seating over the drumhead on the drum shell, and an apparatus controller configured for operably interfacing with the drumhead tuning rim apparatus so as to selectively control the cable tension dial assembly and thereby adjust the overall pitch of the drumhead as by adjusting the tension on the rim.

17 Claims, 14 Drawing Sheets

(56) References Cited

U.S. PATENT DOCUMENTS

| | | | | |
|---|---|---|---|---|
| 2,173,443 | A * | 9/1939 | Schuman | G10D 13/023 235/1 C |
| 2,495,450 | A | 1/1950 | Gladstone | |
| 3,215,019 | A | 11/1965 | Sloan | |
| 4,312,259 | A * | 1/1982 | Henrit | G10D 13/023 84/411 A |
| 5,934,599 | A | 8/1999 | Hammerslag | |
| 6,040,513 | A | 3/2000 | Belli | |
| 6,202,953 | B1 | 3/2001 | Hammerslag | |
| 6,289,558 | B1 | 9/2001 | Hammerslag | |
| 6,410,833 | B1 * | 6/2002 | Brando | G10D 13/023 84/411 R |
| 6,441,286 | B1 * | 8/2002 | Brando | G10D 13/023 84/411 R |
| 6,667,432 | B2 * | 12/2003 | Brando | G10D 13/023 84/411 R |
| 6,812,392 | B2 * | 11/2004 | Brando | G10D 13/023 84/411 R |
| 7,045,696 | B2 | 5/2006 | Henry | |
| 7,591,050 | B2 | 9/2009 | Hammerslag | |
| 7,888,575 | B1 * | 2/2011 | Toscano | G10D 13/023 84/413 |
| 8,091,182 | B2 | 1/2012 | Hammerslag et al. | |
| 8,424,168 | B2 | 4/2013 | Soderberg et al. | |
| 8,642,867 | B1 * | 2/2014 | Bedson | G10D 13/023 84/413 |
| 9,006,548 | B2 * | 4/2015 | Bedson | G10D 13/023 84/413 |
| 9,349,355 | B2 * | 5/2016 | Jones | G10D 13/023 |
| 2004/0159209 | A1 | 8/2004 | Henry | |
| 2012/0246974 | A1 | 10/2012 | Hammerslag et al. | |
| 2016/0240175 | A1 * | 8/2016 | Bedson | G10D 13/023 |
| 2017/0040005 | A1 * | 2/2017 | Welch | G10D 13/023 |

OTHER PUBLICATIONS

Drum Tech "DTS—Drum Tuning System" web page content obtained Jan. 25, 2017 from http://www.drumtech.com/dts-drum-tuning-system.

Drum Tech "DTS 'One-Touch Drum Tuning System'" YouTube video landing page content obtained Jan. 25, 2017 from https://www.youtube.com/watch?v=JYxBNrq8ldc.

* cited by examiner

DRUMHEAD TUNING RIM SYSTEM AND METHOD OF USE

RELATED APPLICATIONS

This is a continuation-in-part application of a prior filed and currently pending U.S. application having Ser. No. 14/576,186 and filing date of Dec. 18, 2014, which is itself a continuation-in-part application of a prior U.S. application having Ser. No. 14/383,510 and filing date of Sep. 5, 2014, which is now U.S. Pat. No. 9,006,548 issued on Apr. 14, 2015, which is itself a U.S. national stage entry from international PCT patent application number PCT/US2014/010532 filed Jan. 7, 2014, itself claiming priority to a prior U.S. application having Ser. No. 13/740,148 and filing date of Jan. 11, 2013, which is now U.S. Pat. No. 8,642,867 issued on Feb. 4, 2014, each entitled "Drumhead Tuning Rim Apparatus and Method of Use," the contents of all of which are incorporated in their entireties herein by reference.

BACKGROUND OF THE INVENTION

Incorporation by Reference:

Applicant hereby incorporates herein by reference any and all patents and published patent applications cited or referred to in this application.

Field of the Invention:

Aspects of this invention relate generally to musical drums, and more particularly to devices for holding and tuning a drumhead on a drum shell and systems incorporating such devices.

Description of Related Art:

As is known in the art, musical instruments generally referred to as "drums" are typically comprised of a drum shell and one or more drumheads. The drum shell is usually a hollow annular body of wood or other material having a certain diameter and length or depth. A drumhead is essentially a membrane, traditionally of animal skin and now more often of synthetic fiber such as polyester, Mylar, Kevlar or other suitable material, that is stretched over one or both open ends of the drum shell so as to vibrate and produce a tone when struck by the hand, a drum stick, or other object. Each drumhead is typically formed with a relatively rigid hoop about its perimeter, which is configured to seat on or about an open end of the drum shell. The drumhead may thus be held in place and in tension on the drum shell by affixing it thereto, either with bolts through metal "claws" attached directly to the hoop of the drumhead or with bolts through holes in a flanged rim that fits over the drumhead hoop and effectively pinches or traps the drumhead hoop between the rim and the drum shell. The bolts, called tension rods, are screwed, as with a drum key, into threaded lugs attached to the drum shell in order to secure and tune the drumhead. Depending on the size and style of the drum, ranging from large bass drums to small toms and the classic snare drum, the drum shell and corresponding rim(s) may be configured with six, eight, or twelve tension rod and lug sets or pairs.

The challenge with the prior art system of securing and tuning a drumhead through the conventional tension rod and lug hardware that has been employed for decades is that producing uniform tension all the way around the drumhead hoop or rim as by individually adjusting each tension rod, and thus evenly tuning the drumhead across its entire surface, is difficult and time-consuming. What is needed and has heretofore been unavailable is a more convenient and effective drumhead tuning rim system and method. Aspects of the present invention fulfill these needs and provide further related advantages as described in the following summary.

SUMMARY OF THE INVENTION

Aspects of the present invention teach certain benefits in construction and use which give rise to the exemplary advantages described below.

Aspects of the present invention are directed to a drumhead tuning rim system for securing and tuning a drumhead on a drum shell of a drum, comprising a drumhead tuning rim apparatus comprising a cable tension dial assembly configured for operably engaging a rim of the drum so as to increase or decrease tension on the rim, the rim being configured for seating over the drumhead on the drum shell, and an apparatus controller configured for operably interfacing with the drumhead tuning rim apparatus so as to selectively control the cable tension dial assembly and thereby adjust the overall pitch of the drumhead as by adjusting the tension on the rim.

A primary objective inherent in the above-described system and method of use is to provide advantages not taught by the prior art.

Another objective is to provide such a system and method that enables uniform tuning of a drumhead through interaction with an apparatus controller rather than the multiple tension rods in prior art drumhead hardware configurations.

A still further objective is to provide such a system and method that enables removal or installation of a drumhead through interaction with an apparatus controller and associated loosening or tightening of a single cable rather than threadably disengaging or engaging the multiple tension rods in prior art drumhead hardware configurations.

A still further objective is to provide such a system and method that enables electronic tuning of an otherwise conventional drum or drum kit.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

Features, elements, and aspects of the invention that are referenced by the same numerals in different figures represent the same, equivalent, or similar features, elements, or aspects, in accordance with one or more embodiments.

DETAILED DESCRIPTION OF THE INVENTION

The above-described drawing figures illustrate aspects of the invention in at least one of its exemplary embodiments, which are further defined in detail in the following description.

Figure 1:
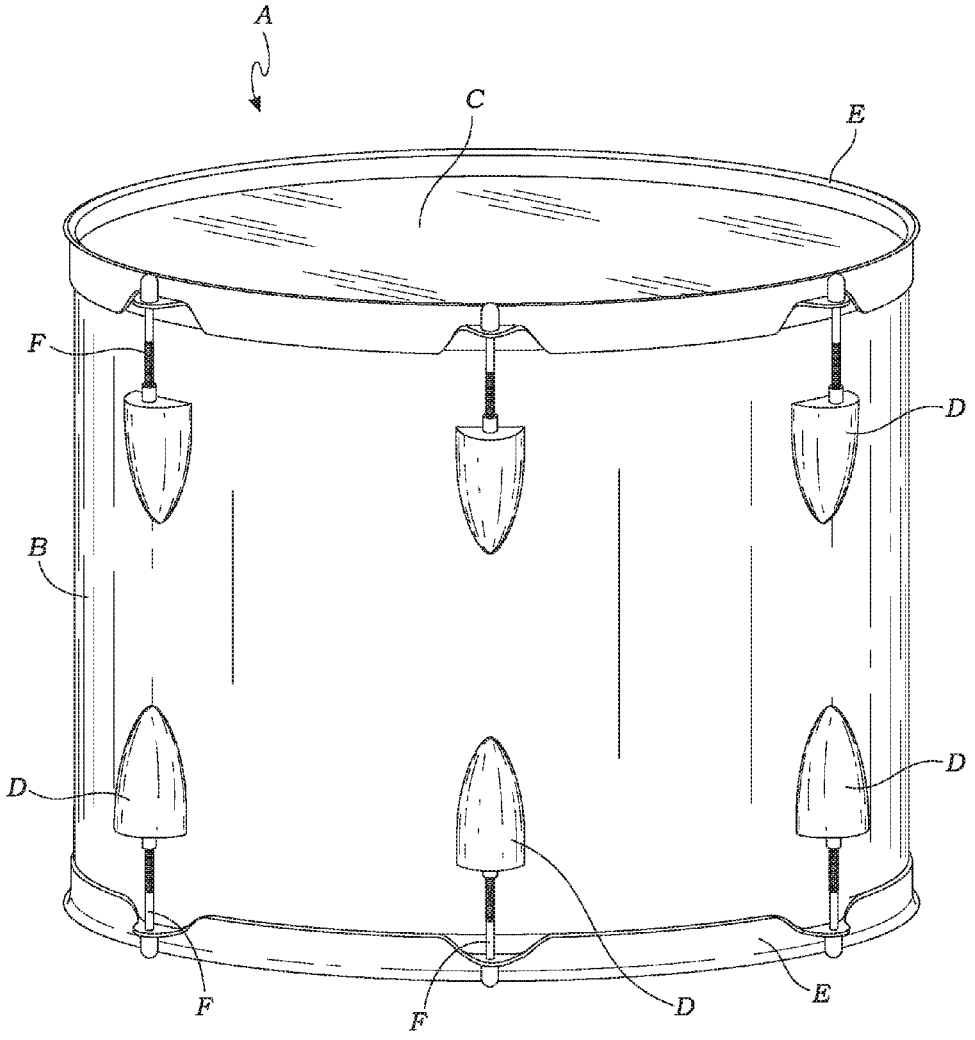
Prior Art Fig. 1
FIG. 1 is a perspective view of an exemplary prior art drum with drumhead mounting hardware.

By way of further background, and with initial reference to FIG. 1 depicting a typical tom-tom drum as is known and used in the art, the drum A is comprised of a drum shell B and one or more drumheads C stretched over one or both open ends of the drum shell B. The drum shell B is configured with lugs D spaced about its circumference, one row of lugs D for each of the top and bottom rims E. Each such rim E is configured to seat about a hoop or edge (not shown) of the drumhead C and so trap or retain the drumhead C about an open end of the drum shell B. The rim E is formed with a flange having through-holes into which are inserted bolts or tension rods F for threadable engagement with the respective lugs D. As such, the drumhead C is tuned in the prior art drum A by selectively tightening or loosening the tension rods F, whether by hand or using a drum key or other tool (not shown), so as to put the desired amount of tension or stretch on the portion of the drumhead C corresponding to the respective tension rod-lug pair. Depending on the size and style of the drum, there may be from six to twelve or more such pairs of tension rods and lugs that would need to be individually adjusted in an effort to create uniform tension over the entire drumhead and thus tune the drum—in the exemplary prior art drum A there are twelve pairs of tension rods F and lugs D, six on the top and six on the bottom, though only three of the pairs on each of the top and bottom, or six pairs total, are visible in the perspective view of FIG. 1. It will be appreciated by those skilled in the art that the typical prior art system for securing and tuning a drumhead through a number of such conventional tension rod and lug hardware pairs is relatively difficult to use and time-consuming even for experienced drummers. Therefore, it is desirable that a more simplistic approach to securing and tuning a drumhead be provided.

Figure 2:
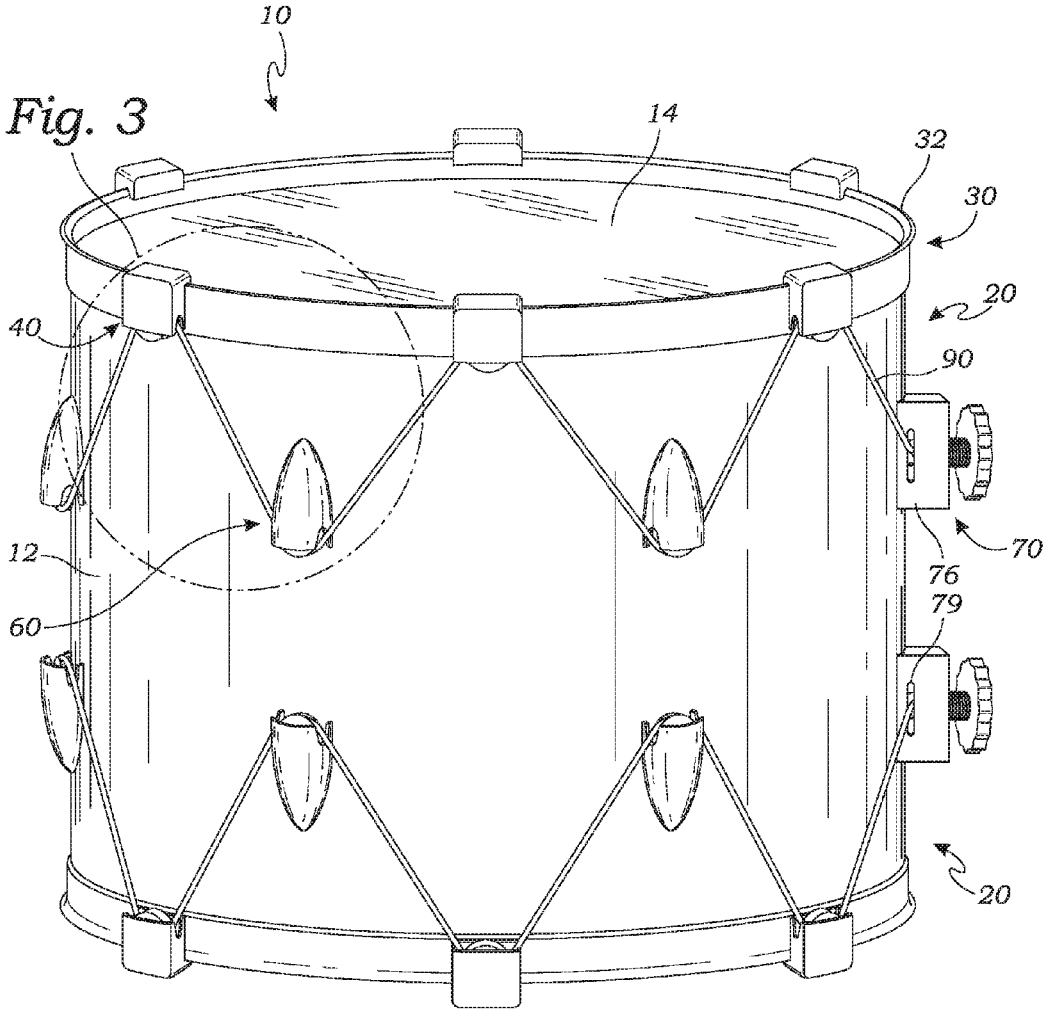
FIG. 2 is a perspective view of an exemplary embodiment of the invention.

Turning now to FIG. 2, there is shown a perspective view of an exemplary embodiment of a drumhead tuning rim apparatus 20 according to aspects of the present invention as employed in connection with a drum 10 having a drum shell 12 and at least one drumhead 14. The apparatus 20 comprises, in one embodiment, a rim 30 configured with spaced-apart grooved bearing wheel housing assemblies 40 about its perimeter and corresponding, spaced-apart grooved bearing wheel lug assemblies 60 installed about the perimeter of the drum shell 12, with a single cable 90 running alternately between the housing assemblies 40 and lug assemblies 60 and terminating at its opposite ends in a cable tension dial assembly 70 also mounted on the drum shell 12 so as to allow, based on the operative cooperation of such components of the apparatus 20, securing and tuning of the drumhead 14 on the drum shell 12 as described further below. As shown in FIG. 2, where the drum 10 has a drumhead 14 positioned on both ends of its hollow drum shell 12, two essentially identical drumhead tuning rim apparatuses 20 may be employed in a similar fashion as herein described, one such apparatus 20 associated with each drumhead 14; it will be appreciated that where a drum is configured as having only one drumhead with the other end of the drum open, only one such drumhead tuning rim apparatus according to aspects of the present invention would thus be employed. Moreover, as will be appreciated from the below discussion of the alternative embodiment of FIGS. 8 and 9, in some arrangements a single drumhead tuning rim apparatus may be employed according to aspects of the invention in tuning two opposed drumheads, whether independently or simultaneously. For simplicity throughout the instant Specification, wherever two are shown in the figures, one drumhead tuning rim apparatus 20 is described in terms of its construction and use, the second again being analogous structure and essentially a mirror image of the first. However, in particular applications it may be desirable to configure the tuning rim apparatuses differently from one another in one or more respects even on the same drum, such as when a different effect or functionality of one drumhead versus another is desired or where the drum and particularly the drum shell and thus the sizes and shapes of the respective drumheads are not identical or symmetrical. Those skilled in the art will appreciate that while a particular configuration of the drumhead tuning rim apparatus 20 is shown and described, the invention is not so limited, but instead may take other forms and involve other components and materials now known or later developed without departing from the spirit and scope of the invention. Furthermore, it is noted that while further aspects of the present invention relate to a system for the electronic or electro-mechanical tuning of a drum employing a drumhead tuning rim apparatus 20 according to aspects of the present invention, it will be appreciated that such a "system" is more broadly to be understood as any arrangement of components according to aspects of the present invention, whether manually operated, electronically or electro-mechanically operated, or otherwise, such that any and all embodiments presented herein are or define a system according to aspects of the present invention.

With continued reference to FIG. 2, a number of grooved bearing wheel housing assemblies 40, six in the exemplary embodiment, are attached or mounted on the rim 30 of the drum 10 at evenly spaced intervals, replacing the traditional tension rod holes formed on the typical hoop rim E (FIG. 1). At substantially equal spacing about the perimeter of the drum shell 12 there are positioned corresponding grooved bearing wheel lug assemblies 60. It is noted that while in the exemplary embodiment there are six grooved bearing wheel housing assemblies 40, there would only be five corresponding grooved bearing wheel lug assemblies 60, as the sixth position about the perimeter of the drum shell 12 between one pair of housing assemblies 40 would instead be taken by the cable tension dial assembly 70, more about which is said below in connection with FIGS. 6 and 7. In the exemplary embodiment, each such lug assembly 60 is located circumferentially substantially midway between the closest two housing assemblies 40. Moreover, the lengthwise offset distance down the drum shell 12 from the rim 30 at which the lug assemblies 60 are located is substantially equal to the circumferential distance from a particular lug assembly 60 to each adjacent housing assembly 40, whereby the angle that the cable 90 bends as it goes through each housing or lug assembly 40, 60 is approximately ninety degrees (90°), though it will be appreciated that this angle can vary depending on a number of factors, such as the desired configuration of the rim 30 and spacing of the housing assemblies 40 thereabout, the type and length of the drum shell 12 and the resulting position thereon of the lug assemblies 60, and the intended drumhead 14 and the amount of tension that is to be put on it, such that it is to be expressly understood that the invention is not limited to the particular positions and spacing of the housing and lug assemblies 40, 60, which are merely illustrative of aspects of the present invention. Relatedly, though the housing assemblies 40 are shown as being at substantially the same locations as would be the tension rods F in a conventional drum A as shown in FIG. 1, or the lug assemblies 60 at substantially the same locations as would be the lugs D, it will be appreciated that such locations of the housing or lug assemblies 40, 60 may vary from those shown without departing from the spirit and scope of the invention. It is noted that while the present invention is shown and described in connection with installation on a drum 10, the components of the drumhead tuning rim apparatus 20 may be sold separately from any drum, such as for an aftermarket installation, in which case it is preferable that the lug assemblies 60 and the cable tension dial assembly 70 be configured to be installed in holes already formed in the drum shell B, or in the locations where the lugs D were originally installed, though again this is not necessary. In any case, it will be appreciated that the components of the drumhead tuning rim apparatus 20, including the rim 30 with housing assemblies 40 thereabout, the lug assemblies 60, the cable tension dial assembly 70, the tensioning cable 90, and assorted bolts and nuts or other fasteners and the like, may be sold as a kit, whereby any prior art drum A can be converted from a conventional tension rod and lug rim securing and tuning system to a "dial-tune" system according to aspects of the present invention. Therefore, while the present invention is shown and described in the context of installation on a drum 10, it is to be understood that the drumhead tuning rim apparatus 20 may exist apart from any such drum, particularly for the purpose of distribution and sales. Relatedly, the housing assemblies 40 of whatever configuration may not only be integrally formed with the rim 30 as by machining, forming, casting, etc. or otherwise permanently mounted thereon as by welding, bonding, etc. but may also be removably engageable with the rim, whether the rim is a prior art rim E as shown in FIG. 1, with the housing assemblies 40 installed or engaged with the traditional tension rod holes formed on the typical hoop rim E, for example, or some other rim formed according to aspects of the present invention, such that the housing assemblies 40 may be formed and sold separately for either aftermarket retrofit applications or simply replacement as desired within installations according to aspects of the invention. Such removable housing assemblies 40 may be attached to the rim 30 using any appropriate technique or device now known or later developed, including but not limited to bolt, pin, hook, clip, slot engagement, press-fit, etc.

Figure 3:
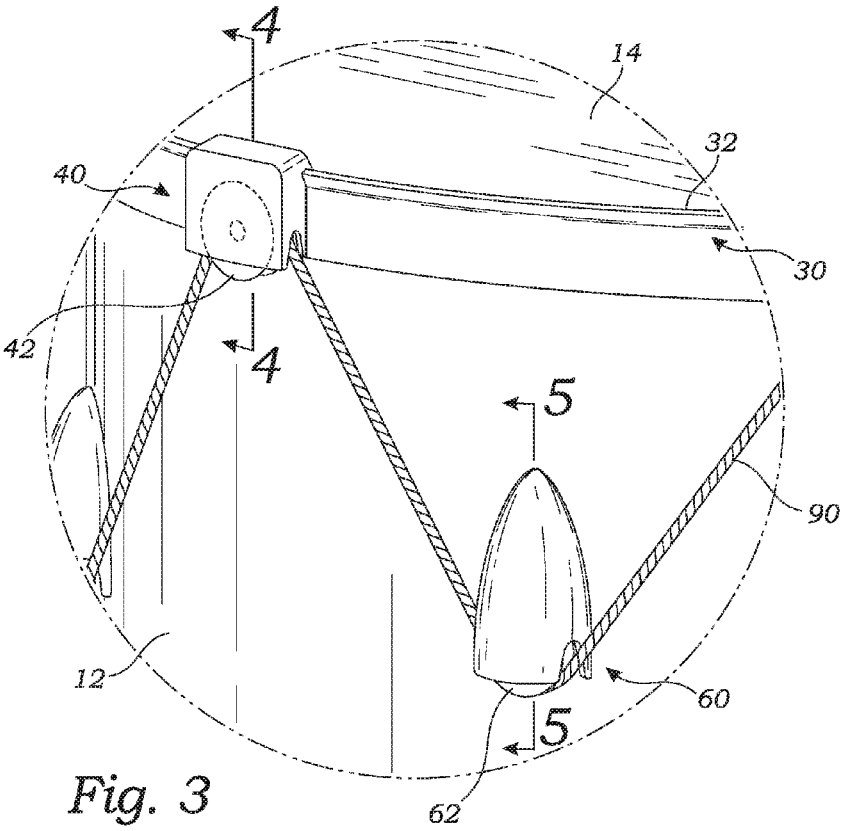
FIG. 3 is an enlarged partial perspective view thereof taken from circle "FIG. 3" of FIG. 2.

Referring next to FIG. 3, there is shown an enlarged partial perspective view of a portion of the drumhead tuning rim apparatus 20 including one each of a grooved bearing wheel housing assembly 40 and an adjacent grooved bearing wheel lug assembly 60 with the tensioning cable 90 passing therebetween on its way around the entire perimeter of the drum shell 12 alternating between such housing and lug assemblies 40, 60 as best shown in FIG. 2. Each housing and lug assembly 40, 60 is thus configured with a grooved bearing wheel 42, 62, respectively, about which the cable 90 runs in a relatively low friction manner as it passes through each component in forming the drumhead tuning rim apparatus 20. In this regard, it will be appreciated that in alternate embodiments the apparatus 20 may not have any wheels 42, 62, but may instead provide other low friction or sliding surfaces on which the cable 90 may run, such as appropriately sized and oriented grooved or notched sliding surfaces. Such sliding-type bearing surfaces may be made of nylon, for example, or any other such low friction material now known or later developed. The cable 90 similarly may be made of a variety of materials now known or later developed, including but not limited to steel or Kevlar® aramid fiber manufactured by DuPont. In any event, "cable" is to be understood broadly as any flexible member that is able to connect and transmit forces between adjacent members or surfaces, and thus may take any form and be made of any material now known or later developed in doing so. In a bit more detail regarding the exemplary wheeled bearing approach, and with reference now to FIG. 4, an enlarged cross-sectional view of the grooved bearing wheel housing assembly 40, the housing grooved bearing wheel 42 is formed having a housing central axle 44 that seats in opposite housing channels 48 formed in the housing body 46, such that the housing grooved bearing wheel 42 is rotatably installed within the housing body 46. At the top of the housing body 46 there is further formed a somewhat downwardly-projecting angled flange 50 defining a somewhat downwardly-opening notch 52 within which a corresponding somewhat upwardly extending circumferential upper rim flange 32 of the rim 30 seats in securing the grooved bearing wheel housing assembly 40 on the rim 30. It will be appreciated that while such an interference or tongue-and-groove type installation of the grooved bearing wheel housing assembly 40 on the rim 30 is shown and described, virtually any assembly technique for securing the housing assemblies 40 about the rim 30, whether permanent or selectively removable or now known or later developed, may again be employed in the present invention without departing from its spirit and scope, including but not limited to set screws, bolts, cross-pins, rivets, adhesives, snaps, slotted engagement, spring clips, spot or tack welding, or crimping. It will be further appreciated that the housing body 46 may take any shape or form as desirable in operably containing the housing grooved bearing wheel 42, while in the exemplary embodiment such housing body 46 is configured to be relatively low profile and essentially just large enough to house the housing grooved bearing wheel 42 substantially hidden from view, with notches or the like formed in the side walls of the housing body 46 as needed for free movement of the tensioning cable 90 about the housing grooved bearing wheel 42; accordingly, any such housing structure capable of functioning as herein described may be employed in the present invention without departing from its spirit and scope. Furthermore, in alternate embodiments, there may be no such housing body 46 at all, but instead such structure, and the housing grooved bearing wheel 42 or other such low friction contact surface for the cable 90, particularly, may be integral with the rim 30 itself; for example, in the case of a bearing wheel, it may simply be rotatably mounted on the rim 30 as by having an axle protruding outwardly therefrom, such that it will be appreciated that the configuration of the housing assembly 40 shown and described herein is merely illustrative of aspects of the invention and non-limiting. Again, in other contexts there may be no wheels at all, but instead low friction surfaces for the cable to ride on attached to or otherwise incorporated into the rim.

Figure 5:
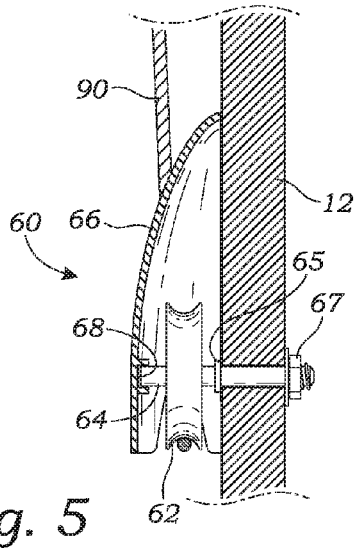
FIG. 5 is an enlarged cross-sectional view taken along line 5-5 of FIG. 3.

Referring to FIG. 5, another enlarged cross-sectional view, the complimentary grooved bearing wheel lug assembly 60 is shown as being configured similarly to the grooved bearing wheel housing assembly 40, with a lug body 66 in which is formed, here, one lug channel 68 wherein one end of a lug central axle 64 of the lug grooved bearing wheel 62 is seated. Rather than being supported at the axle 64's opposite end by another channel formed in the lug body 66, the back of the lug body 66 toward the drum shell 12 is open, and the axle 64 extends inwardly through the lug grooved bearing wheel 62 and a corresponding cross-hole formed in the drum shell 12 to thereby fasten the grooved bearing wheel lug assembly 60 onto the drum shell 12. Specifically, in the exemplary embodiment, the lug central axle 64 is formed opposite its free end that seats in the lug channel 68 with an axle flange 65 configured to abut the drum shell 12 and so space the lug grooved bearing wheel 62 away from the drum shell 12 for free rotation within the lug body 66 about the lug axle 64. The opposite end of the lug axle 64 is then threaded for receipt of a nut 67, with or without a washer, in the conventional fashion, whereby the axle 64 is secured to the drum shell 12 by clamping the shell 12 between the axle flange 65 and a nut 67. Once more, while a particular means for securing the grooved bearing wheel lug assembly 60 onto the drum shell 12 is shown and described, it will be appreciated that any installation method and related hardware, whether permanent or selectively removable or now known or later developed, may be employed without departing from the spirit and scope of the invention. Specifically, the end of the axle 64 may be secured within the channel 68 such that the lug body 66 is thereby also secured to the drum shell 12 by way of the axle 64; or the lug body 66 may be separately installed on the drum shell 12 employing any appropriate means now known or later developed. Moreover, while the lug body 66 is shown as having a somewhat teardrop shape for aesthetic purposes, it is to be appreciated that any styling will do as long as it does not compromise function. Relatedly, the lug body 66 in the exemplary embodiment is configured such that the lug grooved bearing wheel 62 is substantially hidden by the lug body 66, with slots or notches formed in the lug body 66 as needed for passage of the cable 90 even with the lug grooved bearing wheel 62 tucked up under the lug body 66 as shown. Again, those skilled in the art will appreciate that such aesthetic considerations and related form and function of the components may vary from that shown without departing from the spirit and scope of the invention. For example, there need not be a lug body 66 necessarily at all, wherein the lug grooved bearing wheel 62 or other such low friction sliding surface for the cable 90 may be installed directly on or somehow incorporated into the drum shell 12 itself, as noted above for the optional housing body 46.

Figure 6A:
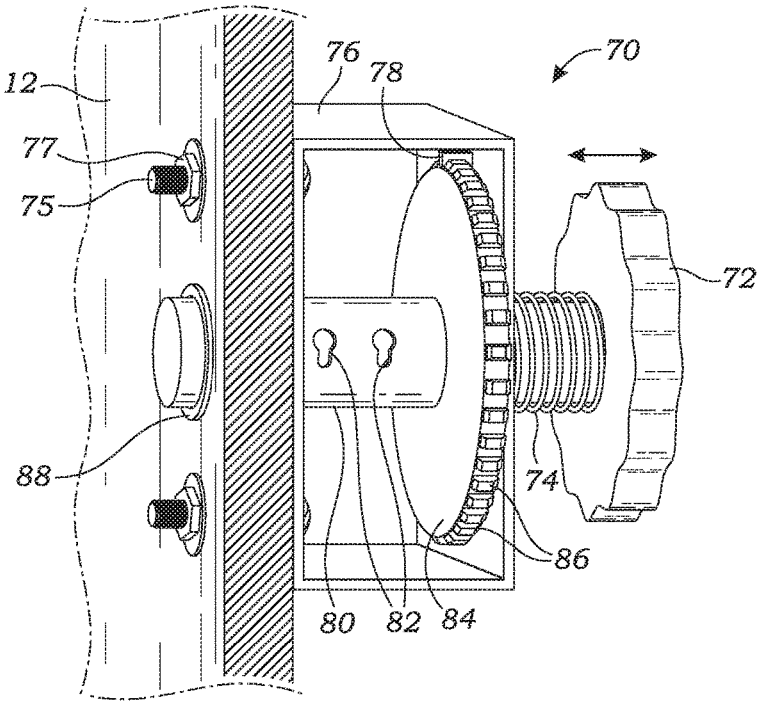
FIGS. 6A and 6B are enlarged partial perspective views thereof in two operative states.
Figure 6B:
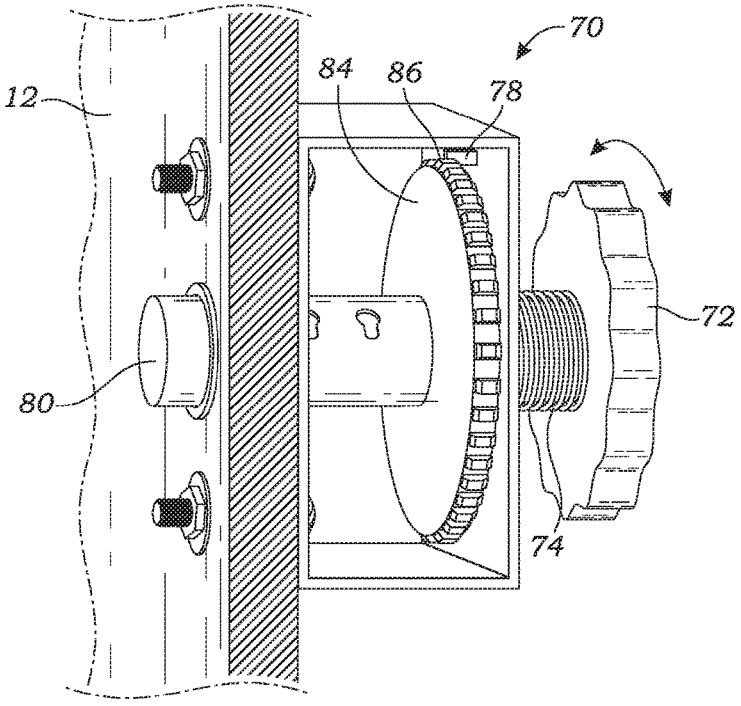

Turning now to FIGS. 6A and 6B, there are shown enlarged partial perspective views of the cable tension dial assembly 70 of the drumhead tuning rim apparatus 20 in two operative states. For simplicity and ease of viewing the inner components of the cable tension dial assembly 70, the side portion or side wall of the cable tension dial body 76 is removed and the tensioning cable 90 (FIG. 2) is not shown. Generally, the cable tension dial assembly 70 comprises a knob or dial 72 installed on a geared shaft 80 operable within the cable tension dial body 76 for selective rotation as by turning the dial 72 so as to increase or decrease the tension in the cable 90 (FIG. 2). In a bit more detail, the dial body 76 is configured as a substantially box-like enclosure that may be installed on the drum shell 12 in any appropriate manner, though as shown this is accomplished through a pair of small bolts 75 and associated nuts 77, with or without washers. It will be appreciated by those skilled in the art that virtually any assembly technique for securing the one or more cable tension dial assemblies 70 on the drum shell 12, whether permanent or selectively removable or now known or later developed, may be employed in the present invention without departing from its spirit and scope, including but not limited to screws, bolts, cross-pins, rivets, adhesives, snaps, slotted engagement, spot or tack welding, or crimping. It will be further appreciated that the dial body 76 may take any shape, size or form as desirable in operably containing the shaft 80 with gear 84, while in the exemplary embodiment such dial body 76 is configured to be relatively low profile and essentially just large enough to house an operably sized shaft 80 and gear 84. As best seen in FIG. 2, the dial body 76 in the exemplary embodiment forms a substantially complete enclosure about the moving parts shown in FIGS. 6A and 6B of the cable tension dial assembly 70, with small slots or openings 79 formed in the dial body 76 at appropriate locations for the passage therethrough of the tensioning cable 90. Small rollers or other such reduced friction surface may be employed in or about the openings 79 as needed in allowing for the relatively free or guided movement of the cable 90 therethrough during use of the drumhead tuning rim apparatus 20 as described further below. Accordingly, any such housing structure capable of functioning as herein described may be employed in the present invention in connection with the cable tension dial assembly 70 without departing from its spirit and scope.

Figure 8:
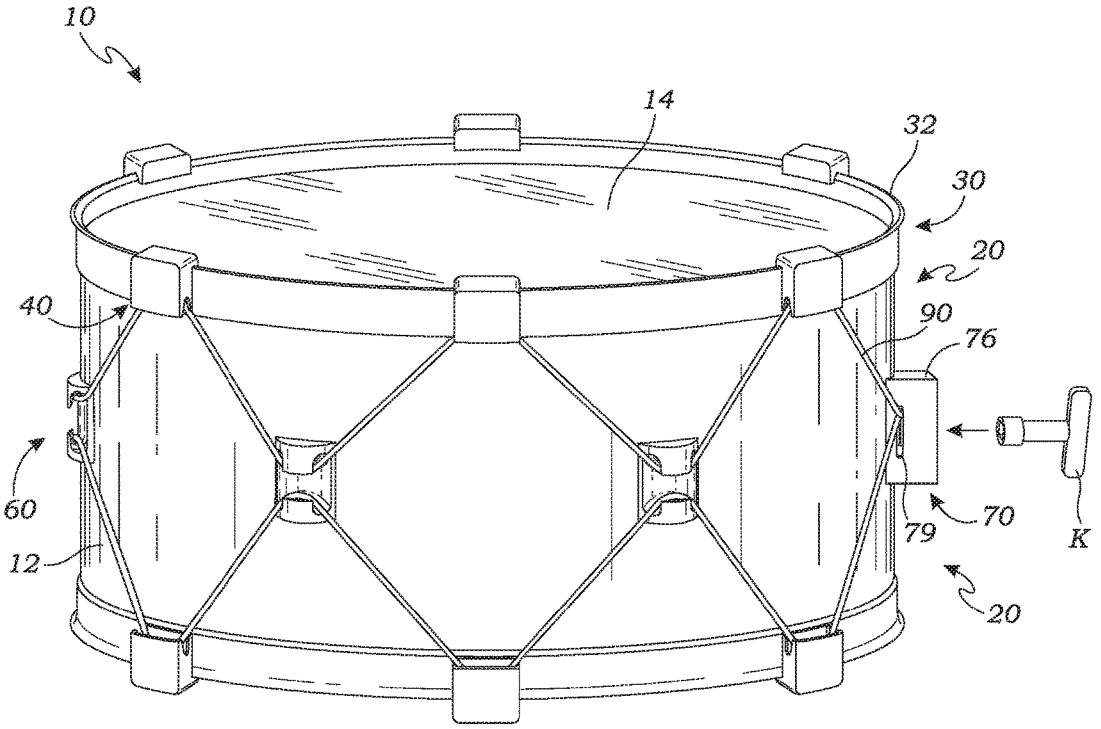
FIG. 8 is a perspective view of an alternative exemplary embodiment of the invention.
Figure 9:
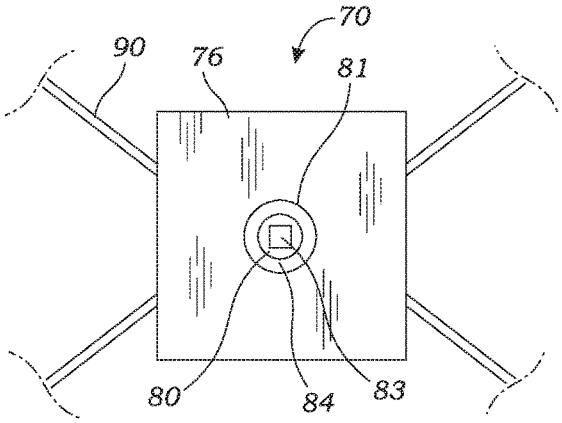
FIG. 9 is an enlarged partial side view thereof.

With continued reference to FIGS. 6A and 6B, positioned substantially centrally within the cable tension dial body 76 is the shaft 80, passing through one or more substantially axially aligned openings (not shown) in the dial body 76 and, in the exemplary embodiment, the drum shell 12. It will be appreciated that in alternate embodiments wherein the dial body 76 is sufficiently spaced from the drum shell 12 or the shaft 80 is otherwise operably supported on both ends spaced from the drum shell 12, an opening for the shaft 80 in the drum shell 12 itself would not be necessary. However, in the exemplary embodiment, in the interest of further supporting the shaft 80 and flushing to the extent possible the cable tension dial assembly 70 on the drum shell 12, the shaft 80 is shown as at least partially passing through the drum shell 12 as through a hole therein (not shown), in which case, though the dial body 76 is shown as having a rear wall immediately adjacent the drum shell 12, it will be appreciated that such wall may be eliminated in whole or in part, particularly where alternate assembly techniques for securing the cable tension dial assemblies 70 on the drum shell 12 are employed. To facilitate relatively frictionless axial and rotational movement of the shaft 80 through such drum shell hole or any opening in the dial body 76, a bushing 88 or the like may be positioned therein. Along the shaft 80 within the dial body 76 there is installed a gear 84 having multiple teeth 86. And between the gear 84 and the drum shell 12 there are formed in or along the shaft 80 one or more shaft holes 82 configured for receipt therein of the free ends of the tensioning cable 90 as it starts and ends within the cable tension dial assembly 70. In this way, it will generally be appreciated by those skilled in the art that with the ends of the cable 90 attached or secured to the shaft 80 in any appropriate manner now known or later developed and the rest of the cable 90 passing alternately through the housing and lug assemblies 40, 60 of the drumhead tuning rim apparatus 20, as above-described in connection with FIGS. 2-5, rotation of the shaft 80 will effectively increase or decrease the tension in the cable 90 and thus raise or lower the overall pitch of the drumhead 14 (FIG. 2) as explained further below. In the exemplary embodiment, the gear 84 is relatively fine-toothed for relatively small incremental ratcheting of the tension in the cable 90, though it will be appreciated that any configuration of the gear 84 and its teeth 86 or other such mechanical means for incrementally rotating the shaft 80 and thus increasing or decreasing the tension in the cable 90 may be employed without departing from the spirit and scope of the invention. At least one pin 78 is formed on the inside of the dial body 76 so as to selectively engage the teeth 86 of the gear 84. Thus, it will be appreciated that when the gear teeth 86 are in contact with the pin 78, the gear 84 and thus the shaft 80 is unable to rotate, thereby "locking" the cable tension as shown in the first operational state of FIG. 6A. While if the shaft 80 is pushed inwardly or in axially toward the drum shell 12, the teeth 86 of the gear 84 would thus be disengaged from the pin 78, thereby allowing the shaft 80 to freely rotate and the tension in the cable 90 to be adjusted as shown in the second operational state of FIG. 6B. Pushing or pulling on or rotating the shaft 80 is facilitated by the dial 72 installed on the free or proximal end of the shaft 80 outside of the dial body 76. In the exemplary embodiment, the dial 72 is formed having an overall size and shape and with grooves, bumps, ribs, knurls or other such surface features to enhance grasping or manipulating the dial 72 in a manner known in the art. It will be appreciated that any appropriate form of the dial 72 accounting for ergonomic, manufacturing and assembly, or other such considerations may be employed in the present invention without departing from its spirit and scope. Furthermore, the dial 72 may be integrally or permanently installed on the shaft 80 or may be temporarily or removably engaged therewith so that the dial 72 can be removed when no tuning is needed to prevent inadvertent adjustment and to again further flush the cable tension dial assembly 70 on the drum shell 12. In a further alternate embodiment, as shown in FIGS. 8 and 9, rather than a dial 72, a traditional drum key K may be employed through engagement with a dial lug 83 formed on the end of the shaft 80, more about which is said below. In this context it will be appreciated that such a drum key K or the dial 72 of the present embodiment effectively serve as the apparatus controller 92 enabling adjustment of the drumhead 14 through interaction with the cable tension dial assembly 70. About the shaft 80 between the dial 72 and the dial body 76 there is positioned a compression spring 74 configured to bias the shaft 80 outwardly such that the gear 84 abuts the inside surface of the dial body 76 and the gear teeth 86 are thereby engaged with the pin 78, once again "locking" the dial assembly 70 and so "setting" the cable tension and thus the particular tuning of the drumhead 14 (FIG. 2). Those skilled in the art will appreciate that alternative configurations of the cable tension dial assembly 70 and its components are possible without departing from the spirit and scope of the present invention. For example, it is possible that the gear 84 could be located at the other end of the shaft 80, whether still within the dial body 76 and potentially resulting in the shaft 80 being pulled rather than pushed to disengage the gear teeth 86 from a pin or the like, or even positioning the gear 84 on the far end of the shaft 80 inside the drum shell 12 and otherwise operating much as described above, thereby potentially further flushing the dial assembly 70 with the drum 10 (FIG. 2) or reducing its overall size, particularly on the outside of the drum as a protrusion. Moreover, the pin 78 may be spring-loaded rather than fixed in order to lock the gear 84 from turning. In this way, when turning the dial 72 and thus the shaft 80 to tighten the cable 90 (FIG. 2), it is not necessary to push in or pull out on the dial 72 in order to free the gear 84; instead, simply rotating the dial 72, in the exemplary embodiment clockwise, would tighten the cable "click by click," locking into place at a particular tension with each "click," and then to loosen the cable, one would simply push in on the dial 72 as described above to release. It will be further appreciated that any and all such components of the drumhead tuning rim apparatus 20 may be formed of any suitable material, such as metal or plastic, through any suitable fabrication process, such as molding, casting, machining, stamping, or forming, whether now known or later developed. Further non-limiting variations in how the cable tension dial assembly 70 is configured and operates include dual ratcheting wherein the dial gear 84 ratchets in either direction, the use of other locking mechanisms now known or later developed to maintain tension, a quick release button, lever, or function to let out the cable 90 quickly for tuning, instead of or in addition to the exemplary push-pull activation and release of the dial 72, and relatedly, a cable 90 that can be disconnected from the take up spool or shaft 80 or one that is permanently attached to the spool or a function to release and attach at least one end of the cable 90, in any case to selectively allow for quick removal and replacement of the drumhead 14 and rapid tuning. It is also possible in particular contexts that there would be a cable tension dial assembly 70 on more than one side of the drum shell 12 even for the same drumhead 14, whereby the assembly could be more easily accessed from multiple directions depending on such factors as the drum kit configuration and even the user's preference in terms of being right-handed or left-handed. Again, it will be appreciated that numerous other variations of the cable tension dial assembly 70 and the overall drumhead tuning rim apparatus 20 beyond those shown and described are possible without departing from the spirit and scope of the present invention.

As a still further example, such as in the alternative embodiments shown and described below in connection with FIGS. 12-19, it will be appreciated that structure and assemblies as herein described as together generally comprising a drumhead tuning rim apparatus according to aspects of the present invention may be arranged and mounted in a variety of other ways, even including the incorporation or installation of much of the hardware on the inside of the drum shell rather than primarily on the outside as shown in FIGS. 1-6, specifically including the option of running the cable(s) through the inside of the drum, in whole or in part. One method by which this could be accomplished would be through the use of frictionless eye-holes in the drum shell through which the cable runs from the outside of the shell into the inside where the lug bearing wheels or surfaces would be positioned, the cable still in this embodiment passing through the shell so as to operably engage rim bearing wheels or surfaces still located on the outside or perimeter of the rim. The take-up reel or cable tension dial assembly for the cable itself could be located inside the drum as well, with only the dial portion on the outside. And as above-described, the dial itself could be removable or even be replaced with a traditional drum key, such that all that would be visible on the outside of the drum in the way of hardware would be one or more holes or openings in the drum shell corresponding to the end of the assembly tuning shaft for access by the dial or key, and in the exemplary embodiment just a portion of the cables running out of the shell up and around the rim bearing wheels or surfaces. Moreover, as particularly shown in the alternative exemplary embodiments of FIGS. 13 and 18, it is possible that the rim bearing wheels or surfaces could themselves be positioned inside of the drum shell such that no portion of even any cable is on the outside of the drum, as for example by modifying the rim to extend downwardly and radially inwardly through openings in the shell or to extend upwardly and radially inwardly and forming small holes in the drum head, in either case thereby moving the rim bearing wheels or surfaces interiorly such that any cable is substantially contained within the shell. It will again be appreciated that any such modifications to or variations of such a drumhead tuning rim apparatus according to aspects of the present invention are possible, such that any specific hardware configurations shown and described herein are to be understood as merely illustrative of features and aspects of the invention and non-limiting. In any case, it will be appreciated that to the extent some or all of the hardware components are housed inside the drum, the less the outer appearance of the drum is altered and the less likely any such hardware could be inadvertently damaged during storage, transport, or use. Moreover, by having relatively more of the hardware contained within the inside of the drum, the less likely it would be that any modifications to traditional drum stands and the like would be needed or preferred, particularly for bass drums that are typically placed on their side during use, in which case in embodiments wherein the hardware and cable(s) are on the outside of the drum, a modified stand or other support might be needed, though not necessarily depending on a number of factors.

Figure 4:
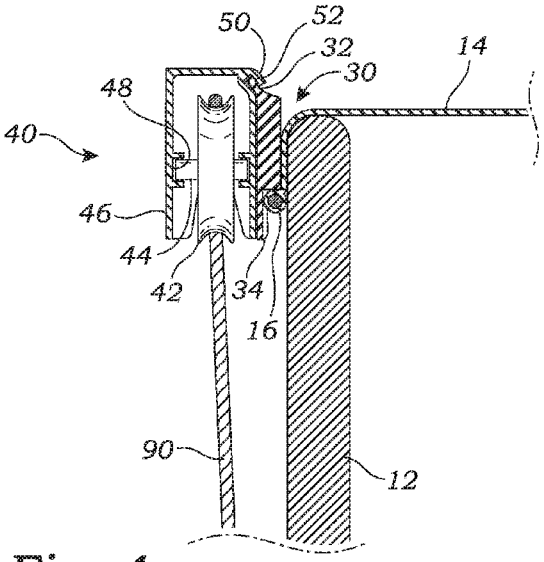
FIG. 4 is an enlarged cross-sectional view taken along line 4-4 of FIG. 3.
Figure 7:
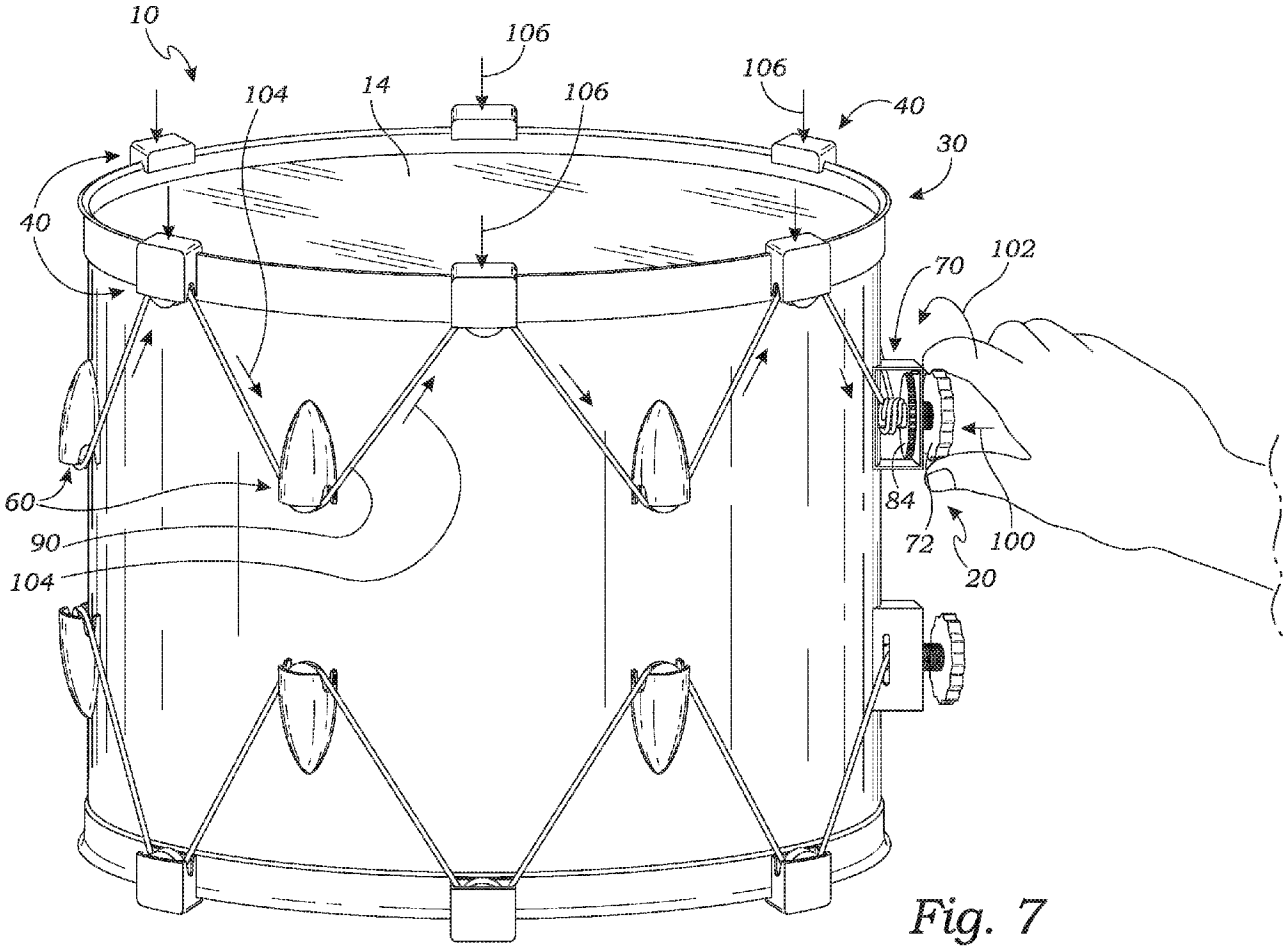
FIG. 7 is a perspective view of the exemplary embodiment of FIG. 2 in use.

Referring now to FIG. 7, in use of the drumhead tuning rim apparatus 20 of the present invention as shown and described in connection with the exemplary embodiment of FIGS. 2-6, installation begins with passing the thin gauge steel or other cable 90 through each of the grooved bearing wheel housing assemblies 40 on the rim 30, leaving the two ends of the cable 90 facing each other between any two of the grooved bearing wheel housing assemblies 40. To mount the drumhead 14, it is simply placed on top of the drum shell 12 in the conventional manner, and then the rim 30 with steel cable 90 in place passing through the grooved bearing wheel housing assemblies 40 is positioned over the drumhead 14 so that the free ends of the cable 90 are substantially adjacent the corresponding cable tension dial assembly 70 and there is substantially equal spacing between the grooved bearing wheel housing assemblies 40 and the grooved bearing wheel lug assemblies 60. It is particularly noted with reference to FIG. 4 that the rim 30 is formed in the conventional manner with a downwardly-opening recess 34 within which is seated the hoop 16 typically formed about the perimeter edge of the drumhead 14 for trapping the drumhead 14's perimeter between the rim 30 and drum shell 12, thus allowing the drumhead 14 to be secured and pulled taught as the rim 30 is tightened down, by individual tension rods F and threaded lugs D in the prior art approach (FIG. 1) or by the operation of the single dial 72 as in the present invention. Once the rim 30 is properly positioned over the drumhead 14 on the drum shell 12, the still loose cable 90 between each grooved bearing wheel housing assembly 40 may be pulled down and looped under the respective grooved bearing wheel lug assembly 60 mounted around the drum shell 12, being careful that the cable 90 is properly seated on each grooved bearing wheel 42, 62 (FIGS. 3-5). In this manner the cable 90 passes alternately from housing 40 to lug 60 to housing 40 around the drum 10. Next, in the case of a first time installation, the free ends of the cable 90 are attached to the shaft 80 of the cable tension dial assembly 70, such as by fitting a metal notch or crimped connector (not shown) on each end of the cable 90 into the fitted or keyed slot or hole 82 in the shaft 80 (FIG. 6). Once the cable 90 is thus secured to the shaft 80 of the cable tension dial assembly 70, simply pressing in on the dial 72 as indicated by arrow 100 disengages the gear 84 as above-described; turning the dial 72 as indicated by arrow 102 then winds the cable 90 about the shaft 80 until the slack is taken out of the cable 90 at all points. Further turning with the dial 72 still pushed in then tightens the cable 90 and thereby increases tension in the cable 90 as indicated by arrows 104, which results in substantially equal downward force at each of the grooved bearing wheel housing assemblies 40 as indicated by arrows 106, and thus across the entire rim 30, resulting in substantially uniform tautness or tuning of the drumhead 14. Once the drum 10 is tuned as desired, pulling out on or simply releasing the dial 72 again locks the gear 84 in place and thereby holds the desired tension on the cable 90. The drum 10 now has the drumhead 14 installed and tuned. It will be appreciated that once any drum 10 is so configured with a drumhead tuning rim apparatus 20 according to aspects of the present invention, replacing a drumhead 14 does not require complete disassembly or removal of the cable 90 from the cable tension dial assembly 70 such that the above steps must be repeated from the beginning. Rather, by simply loosening the cable 90 enough, or putting sufficient slack in the cable 90 as by pushing in the dial 72 and turning it opposite the direction it was tightened so as to "unwind" the cable 90 from the shaft 80, the cable 90 can be removed from underneath the grooved bearing wheel lug assemblies 60, and the rim 30 can simply be lifted off the drum shell 12 and the current drumhead 14 slipped out and a new one slipped in. The rim 30 can then once more be seated on the drumhead 14, again being careful to position the rim 30 such that the housing assemblies 40 are substantially equally spaced from the respective lug assemblies 60, the cable 90 looped beneath the grooved bearing wheel lug assemblies 60, and the dial 72 simply turned to retighten the cable 90 and tune the drum 10 as desired. It will be appreciated by those skilled in the art that similar or related methodologies would be employed according to aspects of the present invention depending on the hardware configuration of the apparatus 20 in use, such that the above-described steps in use are to be understood as merely illustrative and non-limiting.

There are obvious advantages of the drumhead tuning rim apparatus 20 of the present invention over the traditional lug D and tension rod F arrangement. First is the ease with which the drum 10 can be tuned and re-tuned. A person need not be a professional drummer or stage hand to relatively easily and effectively tune the drum 10 to the sound desired. According to aspects of the exemplary embodiment of the invention, simply pressing in the dial 72, turning to tune, and pulling out or releasing the dial 72 to lock it in place is essentially all that is required. One dial and no individual lugs to be tightened means that tuning takes a matter of seconds as opposed to the old method of tuning the drum to itself one tension rod F at a time before raising or lowering the over-all pitch, which itself still required adjusting each of six to twelve tension rods F by the same amount to keep the drum in tune with itself across the head C while adjusting the pitch. Not only is this prior art approach time consuming, but it is very difficult to be precise and it is a daunting task to many drummers. With the present invention, the drum 10 will consistently be substantially in tune with itself, with the pitch of the drum raised or lowered to achieve the desired sound simply with the turn of a single dial 72. Another advantage of the present invention is the relative speed and ease of changing out an old or torn drumhead 14. Rather than removing each individual tension rod F before being able to remove the rim E and thus the drumhead C, with the present invention it is as simple as pressing in on the dial 72 and letting the cable 90 go slack and then slipping the cable 90 from under each bearing lug 60, whereby the rim 30 and drumhead 14 are ready to come off. Installation of the new drumhead 14 is essentially just as easy by following these same steps in reverse. Once more, other such advantages and benefits in use may be realized depending on the context.

Turning now to the alternative embodiment of FIGS. 8 and 9, there is shown a drum 10, here in the form of a snare drum or the like having a relatively shorter drum shell 12, with an alternative drumhead tuning rim apparatus 20 according to aspects of the present invention installed thereon. As can be seen, in this arrangement, single substantially central grooved cable lug assemblies 60 are installed spaced about the drum shell 12, each such assembly 60 having opposed downwardly and upwardly opening grooves or notches in which the respective upper and lower cables 90 run. It will be appreciated that a similar central lug assembly 60 more analogous to the first exemplary embodiment of FIGS. 2-6 could be employed, only here having two bearing wheels rather than cable grooves, whether the wheels are offset as the grooves or are "stacked" one over the other so as to share a common shaft or axle. Similarly, there may be low-friction sliding surfaces such as pins or molded surfaces within the rim housing assemblies 40 rather than bearing wheels, which are not shown in the alternative embodiment of FIG. 8, though again those skilled in the art will appreciate that grooved bearing wheel housing assemblies 40 as in the embodiment of FIGS. 2-7 may again be employed in the present alternative embodiment. Moreover, it will be appreciated that any combination of such bearing features or surfaces is possible in various contexts, such as bearing wheels employed in the rim housing assemblies 40 and low-friction sliding surfaces as shown in FIG. 8 for the lug assemblies 60 or vice versa, or there may even be occasion for mixed uses of such devices within a single apparatus installation, such as using, alternately or otherwise, bearing wheels and bearing surfaces, in either or both the rim housing assemblies 40 and/or the cable lug assemblies 60 or any other substantially functionally equivalent structure now known or later developed. While such an alternative apparatus 20 according to aspects of the present invention is shown and described in connection with a relatively shorter snare drum, it will be appreciated that a similar approach can be employed with drums of virtually any size and shape, including toms as shown in FIGS. 2 and 7, with only the cable 90 potentially changing its angle as it winds its way through the alternating housing and lug assemblies 40, 60, though even the cable angle may be maintained as desired by simply adjusting the spacing between respective housing and lug assemblies 40, 60.

With continued reference to FIG. 8, not only are there shown in the alternative embodiment a single row of shared lug assemblies 60, there is accordingly a single cable tension dial assembly 70 mounted on the drum shell 12 as well, though it will be appreciated that in certain contexts there still could be multiple dial assemblies 70, such as one for each cable and head 14, even if the cables 90 still share common lug assemblies 60 as shown, or vice versa with a single dial assembly 70 but two rows of lug assemblies 60. In any event, as shown in FIG. 8, a single cable tension dial assembly 70 is mounted on the drum shell 12 so as to have slots 79 formed in the dial body 76 through which cables 90 corresponding to the upper and lower drum heads 14 both run. Internally within the dial assembly 70 a shaft and gear arrangement as above-described in connection with FIGS. 2-7 or any other such mechanical arrangement, now known or later developed, consistent with aspects of the present invention may be operably configured, with the cables 90 both wrapping the dial shaft in the same direction so that turning one direction (e.g., clockwise) simultaneously tightens both heads and turning the other direction (e.g., counterclockwise) simultaneously loosens both. Alternatively, the dial assembly 70 may be mechanically arranged such that gearing is selectively engaged based on the use of a switch so that the manipulable dial or key is able to control either the top head or the bottom head independently, in which case it would be necessary that each cable be on a separate shaft or spool, which shaft is again independently and selectively controlled based on the gearing as controlled by the switch. Another possibility would be a middle option that raises and lowers the tension on the opposing heads simultaneously in order to maintain equal variation between head tension while raising and lowering the overall pitch of the drum. Fundamentally, those skilled in the art will appreciate that a variety of mechanical arrangements beyond those disclosed may be employed according to aspects of the present invention without departing from its spirit and scope. Referring still to FIG. 8 and with further reference to FIG. 9, there is shown a drum key K selectively engageable and operable with the cable tension dial assembly 70, rather than a permanent or removable dial 72 as in the embodiment of FIGS. 2-7. Particularly, in this alternative embodiment, a traditional drum key K engages a square dial lug 83 formed on the distal or free end of the dial shaft 80 that is accessible through the opening 81 formed in the dial body 76. The key and lug engagement may be as with standard drum kits, enabling use of a typical drum key K to tune even a drum configured with a new and novel drum tuning rim apparatus 20 according to aspects of the present invention, here still from a single central dial assembly 70, whether for both heads simultaneously or each independently, rather than multiple lugs being individually adjusted to tune a single head as in prior art arrangements. It will be appreciated that other geometrical engagements beyond the exemplary square geometry are possible. As best seen in the enlarged side view inset of FIG. 9 looking into the cable tension dial assembly 70, through the opening 81 there is seen and accessed the internal dial shaft 80 having the outwardly protruding square dial lug 83 with a portion of the gear 84 visible as well, with the square lug 83 again being engageable by the key K, it having an appropriately sized and configured female receptacle feature to engage the square lug 83 in a manner known in the art. Once more, those skilled in the art will appreciate that a variety of other geometrical and mechanical arrangements of the cable tension dial assembly 70 and the overall drum head tuning rim apparatus 10 are possible without departing from the spirit and scope of the invention, as will be further appreciated from the below discussion related to the alternative embodiment of FIG. 17.

Figure 10:
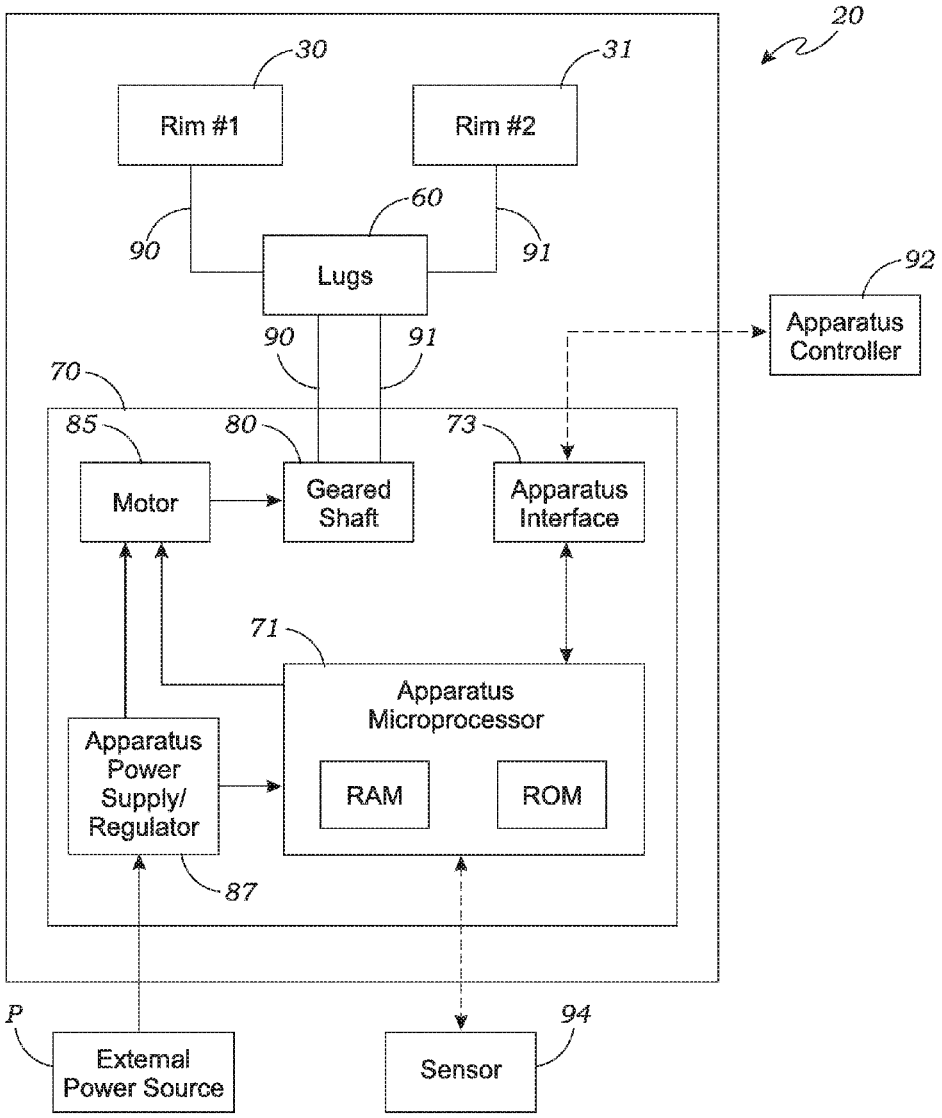
FIG. 10 is a block diagram schematic representation of a further alternative embodiment of the invention.
Figure 11:
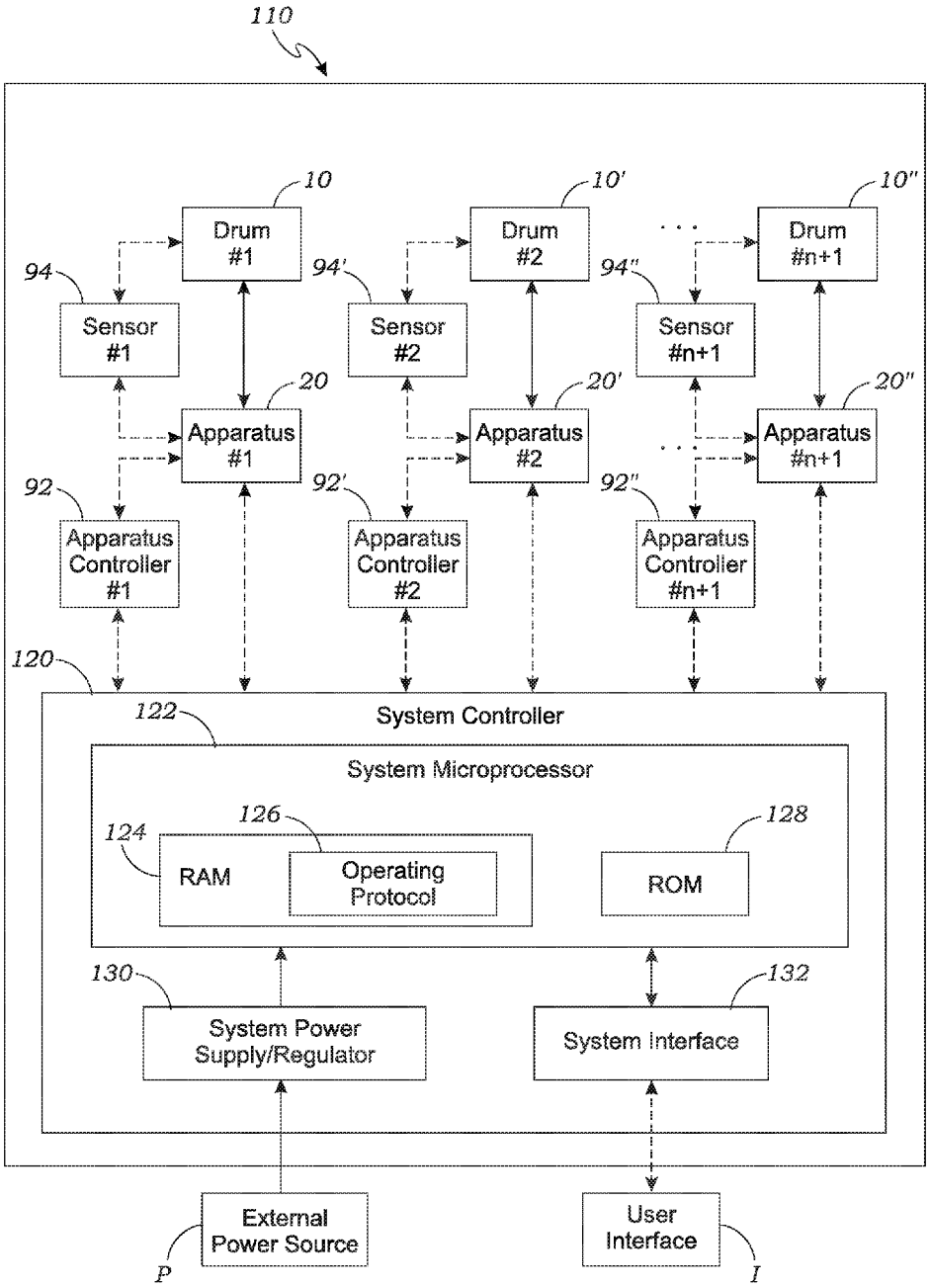
FIG. 11 is a block diagram schematic representation of a still further alternative embodiment of the invention.

Referring next to FIGS. 10 and 11, there are shown schematic block diagrams essentially depicting the new and novel idea of controlling the tuning of an acoustic drum or drum kit electronically (or electro-mechanically), as by having a motor 85 drive the geared shaft 80 of a drum head tuning rim apparatus 20 according to aspects of the present invention in order to tune each drum "up" or "down," with a microprocessor 71 allowing for control through a wired or wireless connection between the apparatus interface 73 and an external controller 92, more about which is said below. Those skilled in the art will appreciate that such a system and method thus enables a conventional drum or drum kit to be tuned in an efficient or even automated manner as by electronic or electro-mechanical control yet with the full, rich, traditional sound and playability of an acoustic drum or drum kit. The resulting system is effectively and advantageously an acoustic-electric hybrid system that can be employed to create or enable an acoustic drum that is even self-tuning and/or self-adjusting. Applications of such a system could include but are not limited to eliminating the need for a drummer to tune his own drum set, allowing the drum set to tune itself and continually maintain tuning through a self-adjusting system, to allow a drummer to customize his tuning preferences and to easily and accurately duplicate those preferences, to allow an acoustic drum set to interact with technology in a way that makes it possible to have preset tuning options saved into an electronic interface (similar to how an electric guitar pedal works) and to access those options with the click of a button. A drummer could potentially adjust the tuning of his entire drum set instantaneously during live play, either between songs or during different sections of a song, for example during a key change. Such a system and method would thus be extremely beneficial for recording studio purposes as well, where rather than spending time and money re-tuning a drum set between songs, or bringing in a separate drum set, an artist could instead access his or her preset tuning options, instantaneously and automatically re-tuning the entire drum set between each song in the recording session. Relatedly, further applications of the present technology could also include a link, via Bluetooth® or any other wireless technology or protocol now known or later developed, between the acoustic drum set and an app on a smart phone, computer, or other technology for the purpose of uploading, downloading, and sharing tuning options as well as saving personal tuning settings and adjusting the drum set on the fly or even from a distance away. Those skilled in the art will appreciate that a variety of system configurations are possible within the spirit and scope of the invention, which will be further appreciated from the following discussion relating to FIGS. 10 and 11 in more detail.

With continued reference first to FIG. 10, there is again shown a schematic block diagram depicting a system for controlling the tuning of an acoustic drum electronically or electro-mechanically. Rather than manually turning the geared shaft 80 as through a dial 72 (FIGS. 6 and 7) or a drum key K (FIG. 8) that adjusts the tension in the cables 90, 91 to the respective upper and lower rims 30, 31 (labeled "Rim #1" and "Rim #2"), a motor 85 instead turns the shaft 80 under the control of a microprocessor 71. It is noted that while the shaft 80 is still described as "geared," it is not necessarily literally so, but instead may be "geared" in the sense that it is driven at various speeds and/or with various amounts of torque under the control of the motor 85, the motor 85 then functionally providing all of the "gearing" for the drive shaft 80. It is further noted that while a single shaft 80 is shown in FIG. 10, the invention is not so limited, as will be appreciated from the foregoing discussion relating to alternative embodiments, and so might entail multiple gear shafts, each driven by the same motor 85 as by effectively a transmission that selective shifts the drive shaft of the motor 85 into engagement with one shaft or the other or neither. Or, there may be employed a separate motor 85 for each shaft 80 when a separate shaft 80 is to be provided for each cable/rim/head set. In any case, the one or more geared shafts 80 may be biased to a locked or non-rotatable position when not being driven, whether still engaged with the motor drive shaft or not, such that whatever setting the shaft is turned to, and hence whatever tension is in a particular cable and whatever resulting tuning of the associated head has been selected, it will remain until a different selection is made and the particular shaft 80 is again driven by the motor 85. Again, here, there are shown a first cable 90 operably engaged with both the geared shaft 80 and the central bearing lugs 60 and the first or upper rim 30 and a second cable 91 also operably engaged with both the geared shaft 80 and the bearing lugs 60 and then the second or lower rim 31. As such, it will be appreciated that the exemplary setup illustrated schematically in FIG. 10 is effectively a representation of the alternative embodiment of FIGS. 8 and 9 wherein a central, shared set of grooved bearing lugs 60 and a single cable tension dial assembly 70 are employed in the drum tuning rim apparatus 20, though again those skilled in the art will appreciate that a variety of alternative arrangements of the hardware and thus of the electronic control and resulting system beyond that illustrated in FIG. 10 are possible, such that it will be appreciated that the schematic is merely illustrative of aspects of the invention and non-limiting. It is further noted that while the upper and lower or first and second rims 30, 31, are shown in FIG. 10 as being part of the drum tuning rim apparatus 20, it will be appreciated that the rims may be standard rims or otherwise separate from the apparatus 20, as when the housing assemblies 40 are removably engaged with each rim. The microprocessor 71 is shown as having RAM and ROM memory and is generally configured with the appropriate circuitry and firmware to enable communication and control in a manner generally now known or later developed in the art. At the very least, the apparatus microprocessor 71 would include in its ROM memory software or firmware configured to enable the operation of the processor and the overall apparatus, whereas the RAM memory would include all other data obtained by or sent to the processor 71, such as feedback data from the motor 85 or an external sensor 94 as might measure tension in a cable 90 or stress or pitch of the drumhead 14 or data such as control commands relayed through the apparatus interface 73. The apparatus interface 73 itself may be in wired or wireless communication with an apparatus controller 92. In one exemplary embodiment, as mentioned above, the apparatus controller 92 may be software running on a computing device such as a smartphone, tablet device, computer, or other such device now known or later developed and configured to communicate with the processor 71 through the interface 73, again via a wired or wireless connection. Instead or in addition, the apparatus 20 may be configured with a controller 92 directly on the apparatus, such as a control panel, one or more selection buttons, touchpad, touchscreen interface, or other such input means for user control of the apparatus 20. Finally, the cable tension dial assembly 70 may be equipped with an on-board apparatus power supply/regulator 87 for taking power from an external power source P such as an A/C source, and thereby operably powering the microprocessor 71, the motor 85, and any other components of the system, directly or indirectly. As will be appreciated, the connection to the external power source P may be constant, as by plugging the apparatus 20 into such a power source (e.g., an outlet), or may be temporary, as by plugging the apparatus 20 in just long enough to charge the on-board power supply/regulator 87 (e.g., a rechargeable battery). It will be appreciated that any means of powering the system now known or later developed is possible in the present invention without departing from its spirit and scope, such that those power components shown and described are to be understood as merely illustrative and non-limiting. More generally, those skilled in the art will appreciate that aspects of such a system and method can be achieved by a variety of means that include but are not limited to the use of an electric motor 85, attached internally or externally to the cable tension dial assembly 70. Any such motor 85 would effectively be attached to the dial itself and would be capable of increasing or decreasing tension on the drumhead 14 by means of turning the dial one direction or the other. The motor 85 would be either self-monitoring and auto-adjusting as under the control of the microprocessor 71, or it would be manually adjusted, as by selectively operating a button, lever, switch, dial or knob, etc. remotely or directly on the unit. This motor 85 could be triggered by some form of sensor 94, either internal or external, such as being integral to the motor, the dial, or the drumhead, or externally mounted to the drum in any conceivable configuration. In one exemplary embodiment, the sensor 94 would be able to read and determine the overall tension of the drumhead 14 by reading the frequency of vibration that is produced when the head is struck, by reading the surface tension on the head when it is at rest, by acoustically identifying the tone, by sensing the tension of the cable on the dial, or by any other such means now known or later developed. By way of further example, the sensor 94 could be an audio sensor/microphone, a laser or infrared sensor, a pressure sensor, or any other sensor used to determine tone, surface tension, cable tension, etc., again, whether now known or later developed and however appropriately mounted on the drum or otherwise operably installed. Any such information obtained from any such sensor 94 would be relayed back to the motor 85 inside the dial assembly 70 as through the microprocessor 71, again via a wired or wireless connection as represented by the dashed line, and the motor 85 will adjust the head tension accordingly until the desired tension is attained on the drumhead 14, or until the drum produces the desired pitch and tone when struck. The motor 85, attached to the dial assembly 70 or otherwise integral to the apparatus 20 itself, may have a digital interface, whether a touch screen, a manually adjustable control, a simple "preset" button, or some other means by which a specific tension, tone, or frequency, as determined by the user and detected by the sensor 94, is saved into the system and repeated instantly with the "touch of a button." This "button" or "user interface" could be integral to the apparatus 20 itself, or it could be externally connected, for example, wirelessly connected to the apparatus 20 as or via a pedal (like a guitar pedal), a drum pad, a smart phone, tablet, computer, or some other external system or device through which the pre-saved settings can be accessed, any such user interface or input being collectively and generally represented as the apparatus controller 92 of FIG. 10. This way a drummer would have the means of instantly and accurately switching between preset tuning options on his or her acoustic drum or drum set without the need to manually tune or adjust the drum(s) in any way, more about which is said below concerning use of such a system. It is further noted in the context of electronic or electro-mechanical control of an acoustic drum or drum set according to aspects of the present invention that a further exemplary, non-limiting approach beyond the exemplary apparatuses 20 shown and described herein would be to include a drum hoop that is magnetically attached to the drum rim. Through the use of an electromagnetic current, the strength of the magnetism between the two hoops could be adjusted to produce varying tension in the drumhead. The use of an electronic and/or manually adjustable interface to control the electromagnetic current could produce the same level of control and automatic-tuning capabilities as mentioned above. Relatedly, in such alternative embodiments discussed herein where an electronic or electro-mechanical system is employed, it will be appreciated that rather than having a cable tension dial assembly 70 with one or more motors 85 configured for selectively applying tension to the cable 90 running through the housing assemblies 40, effectively a single motor or actuator could instead be installed at each lug or housing assembly position, or spaced as desired about the shell 12, and operably engaged with the rim 30 and so provide selected force or tension to the rim 30 and thus the drumhead 14, with each such motor or actuator or the like being connected wired or wirelessly to an apparatus controller 92 and/or system controller 120 and ultimately a user interface I. Another conceivable exemplary method for producing the same results would be to use a type of skin material in the drumhead 14 itself that responds to electromagnetic current, such that depending on the voltage that is applied to the drum skin itself, the drumhead would respond with different levels of rigidity and vibrate at different frequencies accordingly. As such, those skilled in the art will appreciate that modifications to the hardware components of the system and related methods of use are also possible according to aspects of the present invention in order to render the resulting system operable in particular contexts or alternative configurations without departing from the spirit and scope of the present invention. More generally, any mechanical, electronic, electro-mechanical, electro-magnetic, materials, or other such method of selectively adjusting tension in a cable or a drumhead itself, whether now known or later developed, may be employed in an apparatus or system according to aspects of the present invention without departing from its spirit and scope.

Turning to FIG. 11, also in schematic block diagram format, there is depicted the idea of a system 110 whereby electro-mechanical control of each drum 10, 10', 10" in a kit is tuned via a central system controller 120, generally in keeping with the other aspects of the present invention as set forth herein. Each drum 10, 10', 10", numbered 1 to n+1, signifying essentially any number of drums, is operably configured or paired with its respective drum tuning rim apparatus 20, 20', 20", mechanically or otherwise, and its related sensor 94, 94', 94", again connected wired or wirelessly. Similarly, each drum tuning rim apparatus 20, 20', 20" is wired or wirelessly connected to its respective apparatus controller 92, 92', 92" as above-described in connection with FIG. 10, with each such drum tuning rim apparatus 20, 20', 20" and/or apparatus controller 92, 92', 92", in turn being wired or wirelessly connected to the system controller 120. In that regard, it will be appreciated by those skilled in the art that in certain contexts and configurations the central system controller 120 may interface with and directly control each drum tuning rim apparatus 20, 20', 20", may interface with and directly control each apparatus controller 92, 92', 92", or both. In other contexts of exemplary systems according to aspects of the present invention, there may not even be individual apparatus controllers 92, 92', 92", the central system controller 120 being the means by which all control is accomplished. In any such embodiment, the system controller 120, like any individual apparatus controller 92, may be a dedicated hardware device incorporated into or otherwise operably installed within the system 110 or may be a computing device such as a smartphone, tablet, or computer running software configured to enable the interface between the system controller 120 and one or more of the drum tuning rim apparatuses 20, 20', 20" and/or apparatus controllers 92, 92', 92". Optionally, then, any external user interface I through which a user may interact with the system controller 120 through the system interface 132 may also be a computing device, as might be the case where the system controller 120 is a dedicated device as a control panel or touchscreen interface, which may thus be operated directly on site or remotely via a secondary or external user interface I. With continued reference to FIG. 11, the system controller 120 is shown as comprising a system microprocessor 122 that again includes a RAM memory 124 and a ROM memory 128. The RAM memory 124 stores any particular operating protocol 126 selectively loaded in the processor 122 for operating the drum tuning rim system 110, such as different versions having different degrees of functionality and options (e.g., beginner versus professional systems with various programming capabilities, number of preset or stored tuning configurations possible, etc.). And as above for the individual apparatus controller 92, the RAM memory 124 may also store data sent to or received by the processor 122 both from the individual apparatuses 20, 20', 20" and/or apparatus controllers 92, 92', 92" and the related sensors 94, 94', 94" and from any user interface I selections as transmitted to the processor 122 through the system interface 132, whereby the processor 122 and hence the system controller 120 responds accordingly, at least in part, pursuant to the operating protocol 126 stored in RAM memory 124 of the processor 122. In alternative embodiments the operating protocol 126 may be stored in the ROM memory 128 of the processor 122, as when any such protocol is part of the firmware or basic operational software that is to be pre-installed and permanently reside in the processor 122. Again, a system interface 132 is incorporated in the system 110 and in communication with the processor 122, which system interface 132 itself is in wired or wireless communication with a user interface I as above-described. Finally, analogous to the individual drum tuning rim apparatus 20 of FIG. 10 and the power requirements of the dial assembly 70 of the apparatus 20, the system controller 120 may also be equipped with a system power supply/regulator 130 that is itself selectively connected to an external power source P in any manner now known or later developed for powering the controller 120 and potentially any of the other components of the system 110. It will thus generally be understood and appreciated that aspects of the present invention are further directed to a drum tuning system 110 made up of a number (n+1) of drum tuning apparatuses 20 associated with an equal number of drums 10, optionally further including separate apparatus controllers 92 and sensors 94 for each drum and drum apparatus pair. Whatever the format or configuration of the overall system 110 and the related system and/or apparatus level controllers, it will be appreciated that in order to enable a drummer to customize his or her tunings for a variety of sounds and applications, the system preferably has a manually adjustable option, whether any such user interface is again accomplished via the system controller 120 or the individual apparatus controllers 92, 92', 92" and whether through dedicated hardware or the use or incorporation of a computing device running appropriate software; in some embodiments the individual apparatus controllers 92, 92', 92" are simply incorporated within the overall system controller 120 or the various controllers are one and the same. Accordingly, the drummer would adjust each drum manually to the desired setting, then have the ability to save that setting, whether for the individual drum and/or for the entire drum set. By going through the presets, the drummer would be able to adjust one drum individually and independently of the others (snare drum or kick drum, for example) or adjust the entire drum set in unison. For example, a drummer could have his set tuned to a low end, rock style tuning for one song, then click a button or make a selection on his preset device (user interface) and change the tuning of the entire set to a brighter, jazzier tuning for the next song in the set. The total adjustment would take seconds. Combining the herein described technology with wireless technology such as Bluetooth® or other wireless protocol now known or later developed allows for the use of smart phone or computer applications that would advantageously communicate with the drum tuning rim system 110 according to aspects of the present invention. Any such software applications according to and consistent with aspects of the present invention could be used to create, save, and transfer drum tuning styles and settings between drummers and to upload them to the physical drum set by transferring the data wirelessly between the application and the physical tuning technology on the drum set. Drummers could search specific tuning settings for their specific drum set size and specifications as posted by other users, including professional drummers, and instantly duplicate that tuning on their own drum set. For example, if a drummer desired to play a specific song by a specific artist, he or she could look up specific tunings that other drummers have used for that song, depending on the particular type and dimensions of the drum set that they are using. They could then upload those settings to their set and save them in their preset mode. They could do this for each song in the set, quickly and easily selecting or toggling between tunings for each song that they play. Thus, the system and method according to aspects of the present invention allows for customization and convenience similar to an electric drum set but with the full-bodied projection, warmth, and playability of an acoustic drum set, thereby in essence having the "best of both worlds." It will again be appreciated by those skilled in the art that other embodiments and variations according to aspects of the present invention are possible without departing from its spirit and scope.

Figure 12:
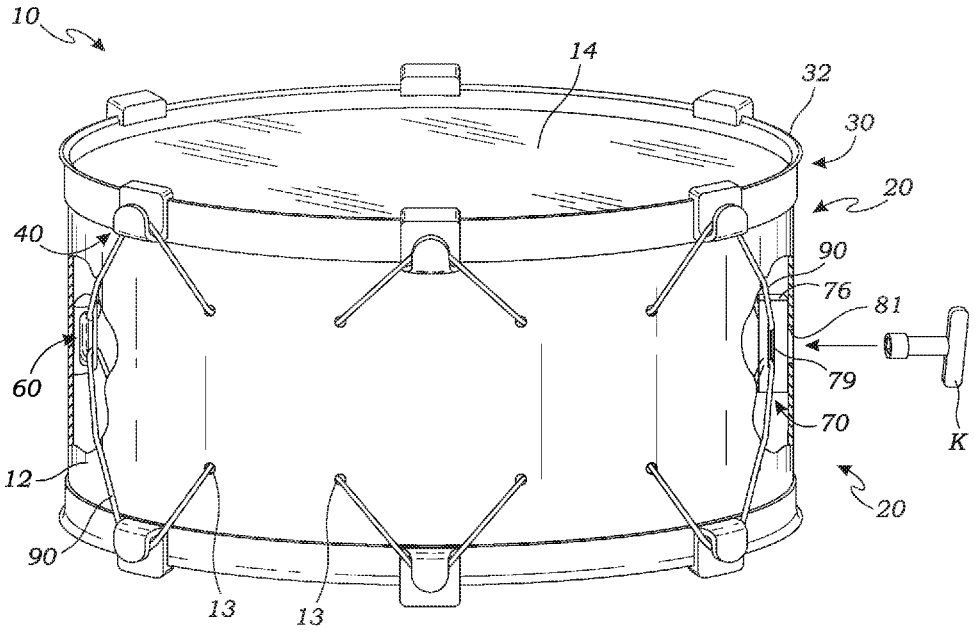
FIG. 12 is a perspective view of a further alternative exemplary embodiment of the invention.

Referring now to FIG. 12, there is shown a drum 10 much like that of FIG. 8 in the form of a snare drum or the like having a relatively shorter drum shell 12, here with a further alternative drumhead tuning rim apparatus 20 according to aspects of the present invention installed thereon. As can be seen, in this arrangement, single substantially central low-friction cable lug assemblies 60 are installed spaced about the drum shell 12 now internally, as being installed on the inside surface of the shell 12, while housing assemblies 40 are again positioned externally on the rim 30, here in the form of low-friction cable retaining surfaces configured somewhat as hooks opening away from the lug assemblies 60 located somewhat centrally about the drum 10. In such, alternative embodiment, the apparatus 20 is thus partially located externally and partially internally, with the cable 90 operating between the external housing assemblies 40 and internal lug assemblies 60 passing through multiple low-friction eye-holes 13 in the drum shell 12. It will be appreciated that the number and locations of such eye-holes 13 may vary depending on a variety of factors such as the size and shape of the drum 10 and the number and spacing of the housing and lug assemblies 40, 60, such that the arrangement shown is to be understood as merely illustrative and non-limiting. Each internal lug assembly 60 may be formed as shown with an enclosed groove or notch in which the respective upper and lower cables 90 run. It will be appreciated that by enclosing the notch the cable 90 within the drum cannot become disengaged from the lug assemblies 60 even as the cable 90 is loosened as when the drumhead 14 is to be replaced. Accordingly, in that context, it is instead the external housing assemblies 40 that are configured in this exemplary embodiment with open notches to facilitate selective disengagement of the cable 90 for removal of the rim 30 and then the drumhead 14, with the drumhead 14 and rim 30 then being easily replaced by simply reversing the steps, looping the cable 90 back over each housing lug 40 as shown, and tightening the cable 90 or taking the slack out of it as by turning or otherwise operating the cable tension dial assembly 70. Even so, those skilled in the art will appreciate that a variety of other arrangements are possible according to aspects of the present invention without departing from its spirit and scope. Once more, a similar central lug assembly 60 more analogous to the first exemplary embodiment of FIGS. 2-6 could be employed, only here having two bearing wheels rather than cable grooves, whether the wheels are offset or are "stacked" one over the other so as to share a common shaft or axle. Moreover, it will be appreciated that any combination of such bearing features or surfaces is possible in various contexts, such as bearing wheels employed in the rim housing assemblies 40 and low-friction sliding surfaces as shown in FIG. 12 for the lug assemblies 60 or vice versa, or there may even be occasion for mixed uses of such devices within a single apparatus installation, such as using, alternately or otherwise, bearing wheels and bearing surfaces, in either or both the rim housing assemblies 40 and/or the cable lug assemblies 60 or any other substantially functionally equivalent structure now known or later developed. While such an alternative apparatus 20 according to aspects of the present invention is shown and described in connection with a relatively shorter snare drum, it will be appreciated that a similar approach can be employed with drums of virtually any size and shape, including toms as shown in FIGS. 2 and 7, with only the cable 90 potentially changing its angle as it winds its way through the alternating housing and lug assemblies 40, 60, and thus the positions of the eye-holes 13 changing accordingly, though even the cable angle may be maintained as desired by simply adjusting the spacing between respective housing and lug assemblies 40, 60.

With continued reference to FIG. 12, it will be appreciated that, along with the lug assemblies 60, here the cable tension dial assembly 70 is also internalized, or installed substantially within the drum shell 12. As shown, in the exemplary embodiment having a single row of shared lug assemblies 60, there is accordingly a single cable tension dial assembly 70 mounted on the drum shell 12 as well, again here internally, though it will be appreciated that in certain contexts there still could be multiple dial assemblies 70, such as one for each cable and head 14, even if the cables 90 still share common lug assemblies 60 as shown, or vice versa with a single dial assembly 70 but two rows of lug assemblies 60. In any event, as shown in FIG. 12, a single cable tension dial assembly 70 is mounted on an inside surface of the drum shell 12 so as to have slots 79 formed in the dial body 76 through which cables 90 corresponding to the upper and lower drum heads 14 both run now all located inside the drum 10. The internal mechanism within the dial assembly 70 may be any appropriate configuration, including but not limited to that shown and described in connection with FIGS. 6A and 6B. Here, as in the alternative exemplary embodiment of FIGS. 8 and 9, there is shown a drum key K that serves as the apparatus controller selectively engageable and operable with the cable tension dial assembly 70, rather than a permanent or removable dial 72 as in the embodiment of FIGS. 2-7. Particularly, in this alternative embodiment with the dial assembly 70 installed internally, an opening 81 in the shell 12 allows access to the dial assembly 70 by the drum key K for selective operation, whether for both heads simultaneously or each independently as herein described. Fundamentally, those skilled in the art will appreciate that a variety of mechanical arrangements beyond those disclosed may be employed according to aspects of the present invention without departing from its spirit and scope.

Figure 13:
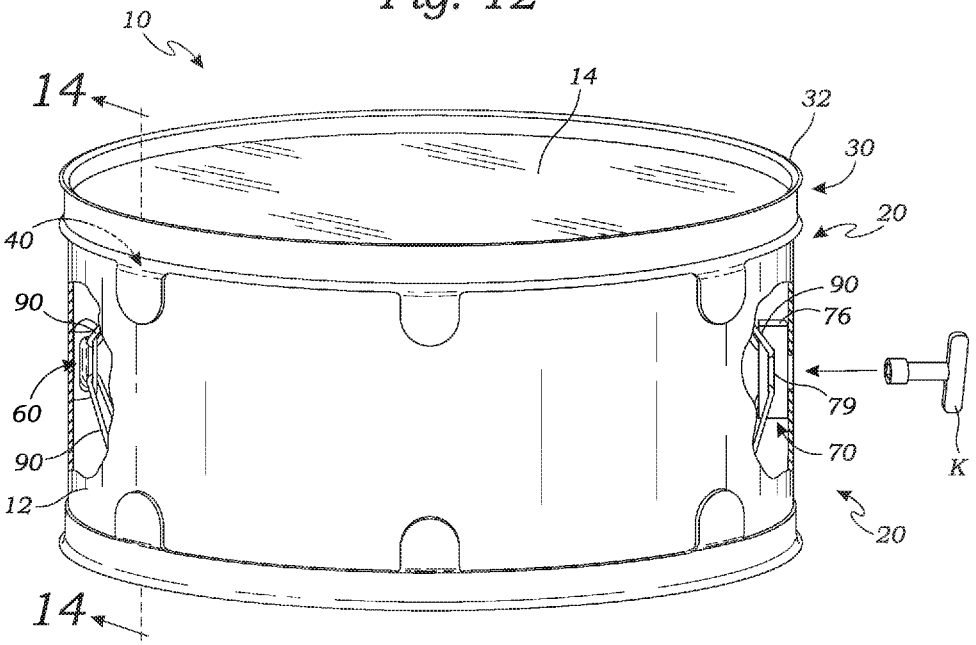
FIG. 13 is a perspective view of a still further alternative exemplary embodiment of the invention.
Figure 14:
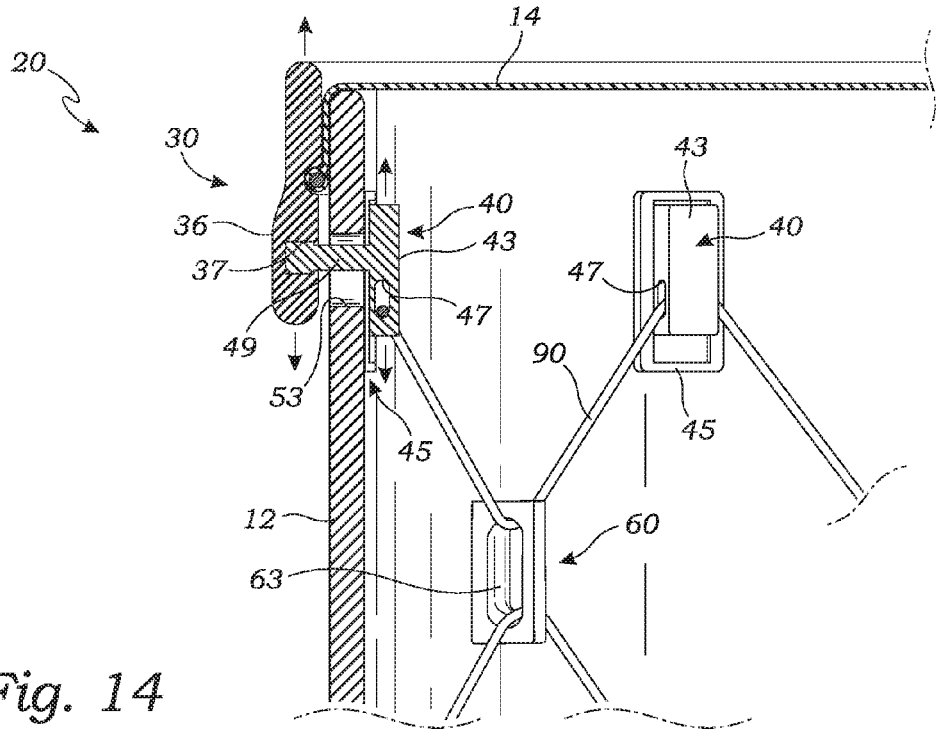
FIG. 14 is an enlarged partial cross-sectional view taken along line 14-14 of FIG. 13.

Turning next to FIGS. 13 and 14, there is shown yet another snare-type drum 10 much like that of FIG. 12, here with a further alternative drumhead tuning rim apparatus 20 according to aspects of the present invention installed substantially entirely internally. That is, in this arrangement, not only are the low-friction cable lug assemblies 60 again installed spaced about the drum shell 12 internally, as being installed substantially centrally about the inside surface of the shell 12, the housing assemblies 40 are here also positioned within the drum shell 12 so as to operate internally while still acting on the rim 30. More particularly, as best seen in the enlarged partial cross-sectional view of FIG. 14, in this alternative embodiment, the housing assembly 40 is configured having a housing base 43 slidably installed within a housing base plate 45 that is mounted on the inside surface of the shell 12. An opening (not shown) in the base plate 45 is aligned with an opening 53 formed in the shell 12. An outwardly-extending housing actuator member 49 protrudes from the housing base 43 through the base plate 45 and shell opening 53 so as to operably engage a respective vertically-extending tab 36 formed on the rim 30. As shown, the tab 36 is configured to extend over the opening 53 and to have an inwardly-oriented receiver 37 for selective receipt of or engagement with the respective housing actuator member 49, again passing through the respective opening 53. It will be appreciated that by securing the housing assembly 40 so as to be substantially vertically slidable, and particularly the housing base 43 within the housing base plate 45, relative to the drum shell 12 and related opening 53, coupling of the housing assembly 40 with the rim 30 as through engagement of the housing actuator member 49 with the rim tab 36 allows vertical movement of the housing assemblies 40 to translate to vertical movement of the rim 30. As in other embodiments herein, such vertical movement of the housing assemblies 40 can be accomplished through selectively tightening or loosening a cable 90 that alternately passes between a housing assembly 40, as by passing through a housing base channel 47 formed in the housing base 43 of each housing assembly 40, and a respective lug assembly 60 as by passing through a similarly formed low-friction lug channel 63, with the cable 90 being alternately tightened or loosened as through operation of the cable tension dial assembly 70 (FIG. 13). Thus, for example, as the cable 90 is tightened, the housing assemblies 40 would be pulled vertically downwardly and so would be the rim 30 at the associated points, such that with the housing assemblies 40 spaced substantially evenly about the rim 30 as in other embodiments, substantially even or uniform tension is placed on the rim 30 and hence the drumhead 14. As with all drawings and related descriptions herein, such are not to be taken to scale or as representing particular sizes or dimensions in any absolute or proportional sense. Accordingly, it will be appreciated that the size and location of the housing assemblies 40 and the related shell openings 53 are merely illustrative and non-limiting. The degree of travel of the housing assemblies 40 and rim 30 can vary as needed, though it will be appreciated that in most contexts a relatively small amount of travel would translate to relatively large or noticeable changes in pitch. In the event that the rim 30 is to be removed altogether as when the drumhead 14 is to be changed, it will be appreciated that rather than requiring significant travel of the housing assemblies 40 or disconnection of the internal cable 90, the rim 30 may simply be disengaged from the housing assemblies 40 as by removing the housing actuator members 49 from the respective receivers 37 formed in the tabs 36 and the rim 30 lifted off of the drum shell 12 to allow removal and replacement of the drumhead 14, all while the drumhead tuning rim apparatus 20 otherwise remains intact internally. The drumhead 14 may then be replaced on the shell 12 and the rim 30 again positioned thereover and engaged with the housing assemblies 40 as described. Various mechanical means now known or later developed for removably engaging the housing actuator member 49 with the tab receiver 37 may be employed, including but not limited to press- or interference fit, snap-fit, and keyed or tongue-and-groove engagement. All such features can be modified or scaled up or down to suit a particular application and related geometric or loading constraints as well as engineering designs and selected materials. Those skilled in the art will appreciate that in the illustrated embodiment the housing assemblies 40 and thus the shell openings 53 are located near the margins of the shell 12, or here near the top somewhat adjacent to the upper rim 30 and drumhead 14, for spatial and leverage effects relative to both the engagement with the rim 30 and operation of the cable tension dial assembly 70.

Figure 15:
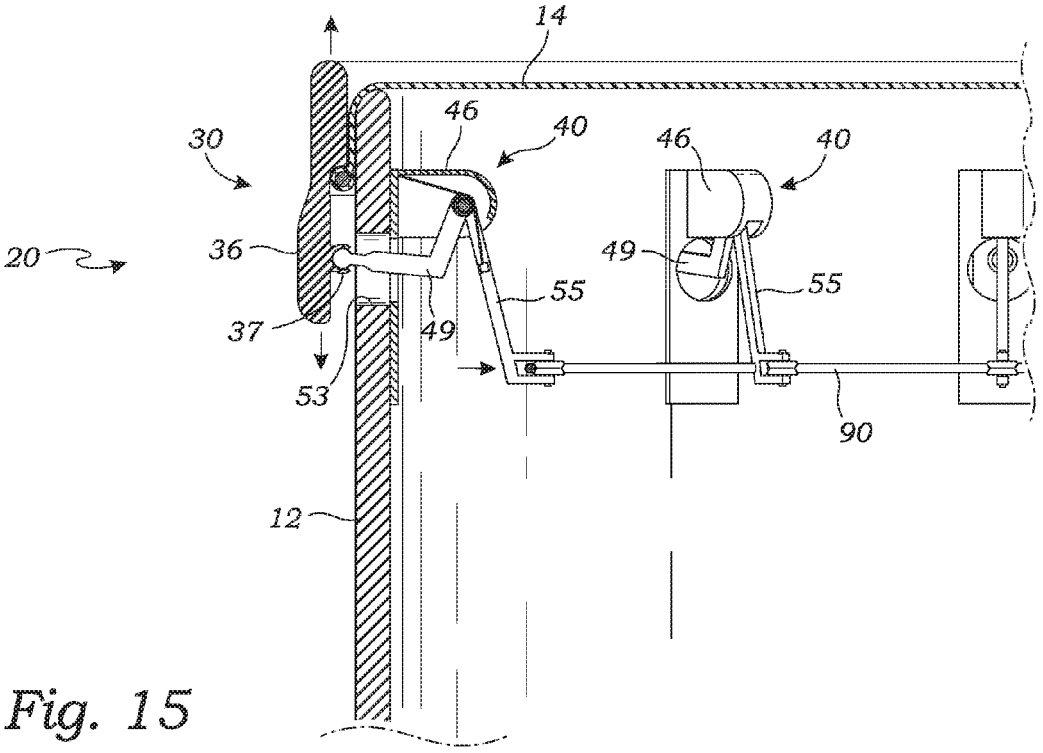
FIG. 15 is an alternative enlarged partial cross-sectional view taken along line 14-14 of FIG. 13.
Figure 16:
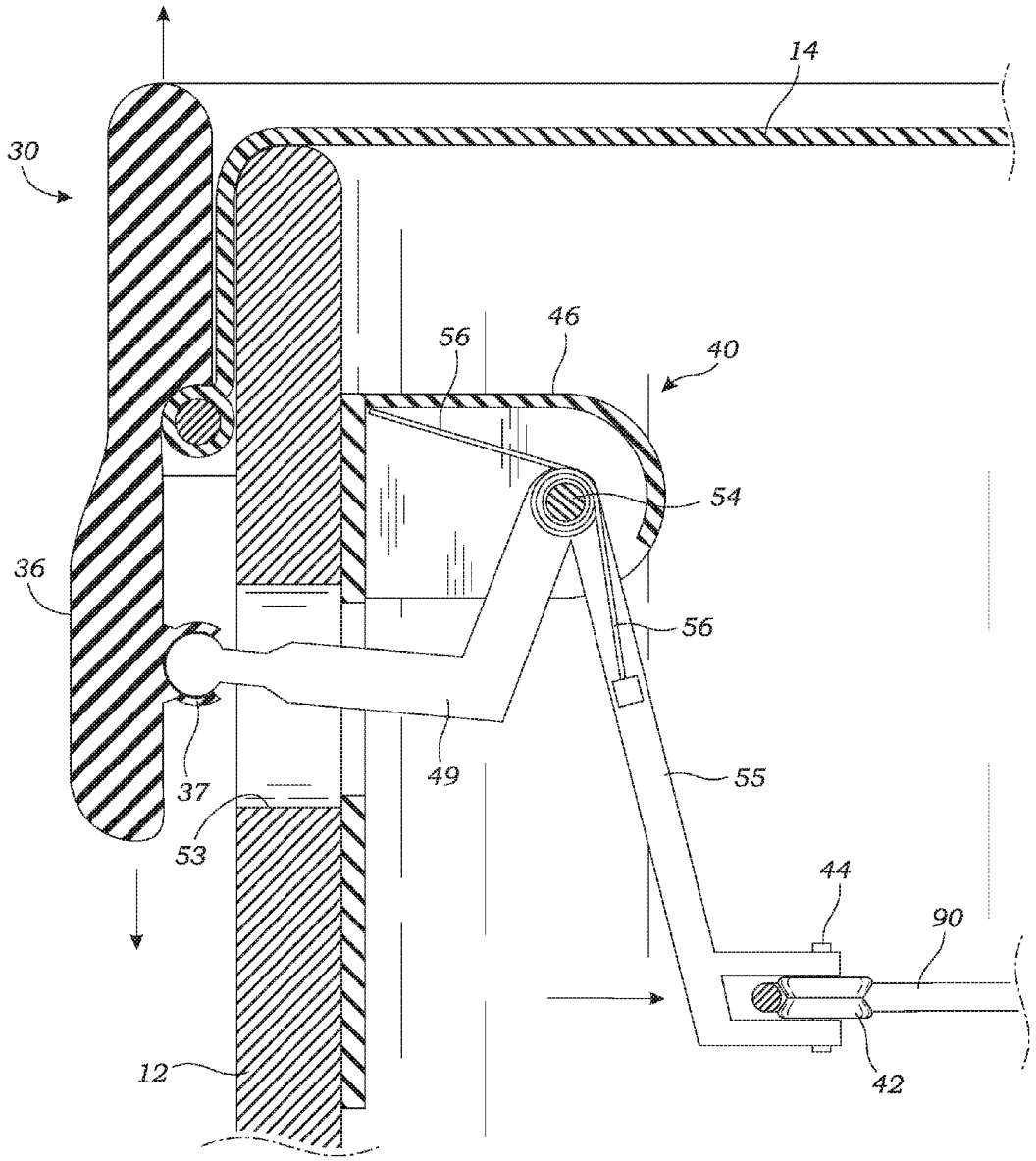
FIG. 16 is a further enlarged cross-sectional view of the alternative embodiment of FIG. 15.

Referring to the further alternative embodiment shown in partial cross-section in FIGS. 15 and 16, a related arrangement for internalizing the drumhead tuning rim apparatus 20 is shown as again involving multiple housing assemblies 40 installed internally so as to mechanically interact with the rim 30 through respective openings 53 in the drum shell 12. Once more, specifically, in the exemplary embodiment, the rim 30 is formed having vertically-downwardly-extending tabs 36 each having an inwardly-oriented receiver 37, here configured as a clip or socket for selective receipt of a corresponding ball formed on the housing actuator member 49. The member 49 is configured to selectively pivot about a housing pivot post 54 formed within the housing body 46 that is again installed on the interior surface of the shell 12 substantially adjacent to the opening 53 through which the housing actuator member 49 operates. It will be appreciated that here as the housing actuator member 49 pivots down, or in the views of FIGS. 15 and 16 rotates counter-clockwise about the post 54, the rim 30 will be pulled down due to the engagement of the actuator member 49 with the tab 36 and thereby tighten the drumhead 14, whereas if the member 49 pivots up, or clockwise in the view of FIGS. 15 and 16, the rim 30 will lift and the drumhead 14 loosen. To effectuate such movement of the housing actuator member 49 in this exemplary embodiment, a housing lever arm 55 is formed integrally with the actuator member 49 so as to extend at an angle therefrom and also pivot about the housing pivot post 54. At the end of the housing lever arm 55 opposite the pivot post 54 and the housing actuator member 49, there is installed in a substantially horizontal arrangement a housing grooved bearing wheel 42 rotatable about a substantially vertical housing central axle 44. It will be appreciated once more that while a bearing wheel 42 is thus shown and described about which the tensioning cable 90 runs, other low-friction bearing or sliding surfaces, whether now known or later developed, may instead be employed. Fundamentally, those skilled in the art will appreciate that in the present alternative arrangement, the tensioning cable 90 is now oriented substantially horizontally as a loop that effectively directly engages the housing assemblies 40 and that when tightened or shortened would serve to pull each of the housing grooved bearing wheels 42 inwardly, thereby pivoting both the housing lever arm 55 and the housing actuator member 49 counter-clockwise as viewed in FIGS. 15 and 16, thus pulling the rim 30 downwardly and tightening the drumhead 14. Loosening the tensioning cable 90 or effectively lengthening it would have the opposite effect, pivoting both the housing lever arm 55 and the housing actuator member 49 clockwise as viewed in FIGS. 15 and 16, thus allowing the rim 30 to shift upwardly and loosening the drumhead 14. A spring 56 may be provided about the housing pivot post 54 within the housing body 46 so as to selectively bias the actuator member 49 and lever arm 55 in a direction. In an exemplary embodiment, the spring 56 is configured to bias the actuator member 49 and lever arm 55 clockwise as viewed in FIGS. 15 and 16 so as to shift the rim 30 upwardly, against which biasing spring 56 it will be appreciated the tensioning cable 90 must act in shifting the actuator member 49 and lever arm 55 counter-clockwise to lower the rim 30 and tighten the drumhead 14. In this way, it will be appreciated that as tension on the cable 90 is released the mechanism is biased open or in the direction of lifting the rim 30, thereby facilitating removal and reengagement of the rim 30 with the housing assemblies 40, by effectively fixing a default spatial location for the housing actuator members 49 with which the rim 30 is to selectively engage. Once more, those skilled in the art will appreciate that a variety of related mechanical arrangements and related component configurations are possible according to aspects of the present invention without departing from its spirit and scope, such that the components of FIGS. 15 and 16 are to be understood as merely illustrative and non-limiting. Notably, it will be appreciated that in the alternative embodiment wherein the tensioning cable 90 directly engages the housing assemblies 40 there are no separate lug assemblies 60 as in other embodiments. Or, put another way, the housing and lug assemblies 40, 60 are effectively combined in the housing assemblies 40 of the alternative embodiment of FIGS. 15 and 16. It will also be appreciated that with the tensioning cable 90 now in a substantially horizontal plane, rather than being in a substantially vertical orientation in the embodiments of FIGS. 2-9 and 12-14, wherein the shaft 80 of the cable tension dial assembly 70 is oriented substantially horizontally (FIGS. 6A and 6B), here things are basically flipped, such that the dial assembly 70, and particularly its take-up shaft 80, should be oriented substantially vertically so as to selectively tighten or loosen the substantially horizontally oriented tensioning cable 90.

Figure 17:
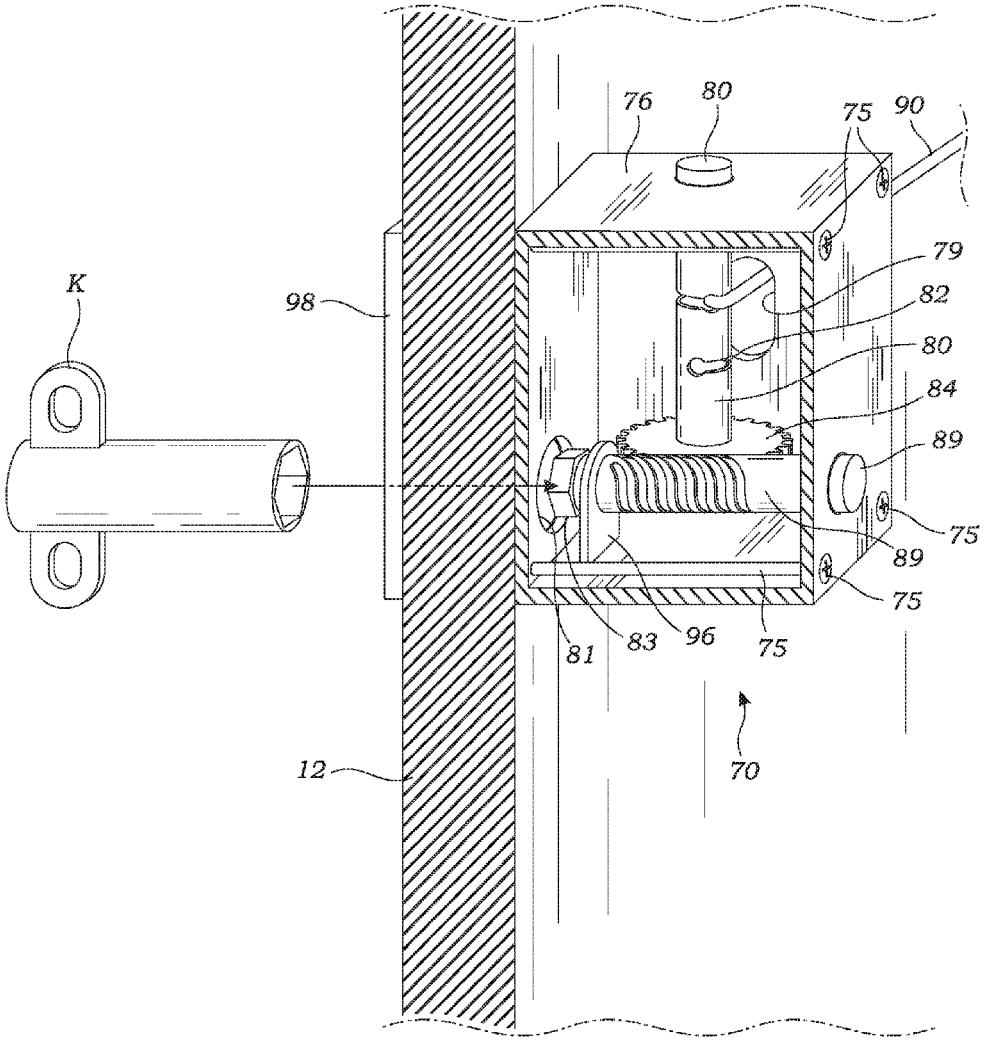
FIG. 17 is an enlarged partial cross-sectional view of a still further alternative exemplary embodiment of the invention.

Turning, then, to FIG. 17, there is shown an enlarged partial cross-sectional view of an alternative exemplary internally-mounted cable tension dial assembly 70 according to aspects of the present invention. For simplicity and ease of viewing the inner components of the cable tension dial assembly 70, the side portion or wall of the cable tension dial body 76 is removed and only one end of the tensioning cable 90 is shown. As in FIGS. 12 and 13, the dial assembly 70 is mounted within the drum shell 12 adjacent to an opening 81 formed therein for purposes of selectively accessing the assembly 70 as with a dial or, as shown, a drum key K. Notably, here, the take-up shaft 80 having holes 82 for connecting the free ends of the tensioning cable 90 is oriented vertically within the dial body 76, whereby a tensioning cable 90 oriented substantially horizontally as in the alternative embodiments of FIGS. 15 and 16 discussed above and FIGS. 18 and 19 discussed below may be wound or taken up on such a vertical shaft 80. Generally, then, in the alternative embodiment, the cable tension dial assembly 70 comprises a substantially horizontal drive shaft 89 configured as a worm gear for engagement with a gear 84 formed on the take-up shaft 80. It is the drive shaft 89 with which the key K, dial, or other such device interacts to selectively control the dial assembly 70 and thus the tension on the cable 90. Accordingly, in the exemplary embodiment, the drive shaft 89 is shown as having a dial lug 83 formed on the free end thereof, or the end closest to the shell opening 81. Opposite ends of the drive shaft 89 and the take-up shaft 80 may be rotationally supported by the dial body 76 or may be completely supported internally. Here, as illustrated, for the purpose of recessing the dial lug 83 within the shell 12, that end of the drive shaft 89 is supported within the dial body 76 by a bracket 96. Those skilled in the art will again appreciate that a variety of mechanical arrangements, whether now known or later developed, for selectively increasing the tension in the cable 90, and whether manual or automated and whether strictly mechanical, electro-mechanical, or electrical or electronic, may be employed according to aspects of the present invention without departing from its spirit and scope. Once more, it is generally noted that the dial body 76 is configured as a substantially box-like enclosure that may be installed on the drum shell 12 in any appropriate manner, though as shown this is accomplished through four small bolts 75. It will be appreciated by those skilled in the art that virtually any assembly technique for securing the one or more cable tension dial assemblies 70 on the drum shell 12, whether permanent or selectively removable or now known or later developed, may be employed in the present invention without departing from its spirit and scope, including but not limited to screws, bolts, cross-pins, rivets, adhesives, snaps, slotted engagement, spot or tack welding, or crimping. It will be further appreciated that the dial body 76 may take any shape, size or form as desirable in operably containing the take-up shaft 80 with gear 84 and the worm gear-style drive shaft 89, while in the exemplary embodiment such dial body 76 is configured to be relatively low profile and essentially just large enough to house an operably sized drive shaft 89 and take-up shaft 80 and gear 84. Once more, the dial body 76 in the exemplary embodiment forms a substantially complete enclosure about the moving parts of the cable tension dial assembly 70, with small slots or openings 79 formed in the dial body 76 at appropriate locations for the passage therethrough of the tensioning cable 90. Small rollers or other such reduced friction surface may be employed in or about the openings 79 as needed in allowing for the relatively free or guided movement of the cable 90 therethrough during use of the drumhead tuning rim apparatus 20 as described herein. Accordingly, any such housing structure capable of functioning as herein described may be employed in the present invention in connection with the cable tension dial assembly 70 without departing from its spirit and scope. Furthermore, particularly in the alternative embodiment wherein the dial assembly 70 is installed internally, it will be appreciated that enclosure of the moving parts is less critical and so the dial body 76 may be removed in whole or in part. A cover plate 98 associated with the cable tension dial assembly 70 may or may not be employed on the outside surface of the drum shell 12, whether for facilitating mounting the internal components or for aesthetics. It is further noted that in such a dial assembly 70 configured for operation with a horizontally-oriented tensioning cable 90 "loop," the take-up point of the assembly 70 (i.e., the vertical location of the take-up shaft 80) defines one point in the loop. Having a fixed take-up position between two lug or housing assembly 40 locations about the drum shell 12 may cause the bearing surfaces 42 on either side of the dial assembly 70 to behave differently than the remaining bearing surfaces 42 or housing assemblies 40 (for example, the six other assemblies, assuming an eight-lug drum configuration). In many embodiments a fixed take-up location would be acceptable relative to the amount or degree of radial movement of the housing bearing surfaces 42 and the resultant negligible effect on the overall tensioning within the system, while in other embodiments, and irrespective of the degree of such housing bearing surface 42 movement or the extent of the change in the overall diameter or size of the cable 90 loop, it may again yet be desirable to account for such movement in the dial assembly 70 as well. As such, in the interest of maintaining a substantially circular or at least symmetrical arrangement of the cable 90 at all points and for all tuning or tension settings of the apparatus 20, rather than being fixed spatially, in an alternative embodiment, the cable tension dial assembly 70, and particularly the vertical location of the take-up shaft 80, may be shiftable radially or in a substantially horizontal plane so as to allow the take-up point to selectively move with the bearing surfaces 42 of the housing assemblies 40 as tension on the cable 90 is increased or decreased. By allowing the take-up assembly 70 to travel inwards or radially as tension is selectively applied, the assembly 70 would continually align itself between adjacent housing assemblies 40, and particularly the bearing surfaces 42 on which the cable 90 runs, at a distance substantially equal or proportional to the tension being applied, thereby assuring substantially equal tension and equal travel at each housing position or point on the cable 90 "loop." It will be appreciated that a number of mechanical arrangements now known or later developed may be employed in achieving such movement of or within the dial assembly 70, including but not limited to a track and/or a spring-biased, free-floating mechanism. Ultimately, whatever the diameter of the cable 90 loop, whether as adjusted or set in its "at rest" configuration or as shifted during use in tuning the drumhead 14, the cable tension dial assembly 70 may be configured so as to have its effective take-up point adjustable as well so as to stay on the same radius with the other bearing surfaces 42. Moreover, in a further alternative exemplary embodiment, the cable tension dial assembly 70 may effectively replace one of the housing assemblies 40 rather than being positioned between adjacent housing assemblies 40 spaced about the perimeter of the drum shell 12; in this way one less housing assembly 40 would be required and the take-up point of the dial assembly 70, or again the vertical location of the take-up shaft 80, would serve as one of the bearing surfaces 42 or one of the points in the cable 90 "loop." In such a case, the take-up assembly 70 both applies tension to the cable 90 while at the same time mechanically applies pressure on the rim 30 at the same rate as the tension created by the cable 90 at each of the other lug or housing assembly 40 positions. Those skilled in the art will again appreciate that a number of such arrangements, employing technologies and components now known or later developed, may be included in a drumhead tuning rim apparatus 20 according to aspects of the present invention without departing from its spirit and scope.

With continued reference to FIG. 17, it will generally be appreciated by those skilled in the art that with the ends of the cable 90 attached or secured to the take-up shaft 80 in any appropriate manner now known or later developed and the rest of the cable 90 passing alternately through the housing assemblies 40 of the drumhead tuning rim apparatus 20 such as above-described in connection with FIGS. 15 and 16, rotation of the drive shaft 89 will in turn cause rotation of the take-up shaft 80 so as to effectively increase or decrease the tension in the cable 90 and thus raise or lower the overall pitch of the drumhead 14 (FIGS. 15 and 16) as explained herein. In the exemplary embodiment, the gear 84 is relatively fine-toothed, which it will be appreciated in conjunction with its interaction with a worm gear will yield relatively small incremental changes in the tension in the cable 90, though it will be appreciated that any configuration of the gear 84 and the worm-gear-style drive shaft 89 and their respective teeth or other such mechanical means for incrementally rotating the take-up shaft 80 and thus increasing or decreasing the tension in the cable 90 may be employed without departing from the spirit and scope of the invention. Those skilled in the art will particularly appreciate the mechanical benefits in terms of gear ratio and torque conversion and, again, incremental rotation, that a worm gear arrangement such as that illustrated in FIG. 17 yields. Moreover, it will be appreciated that such out-of-plane or perpendicular gear arrangements provide a natural mechanical anti-rotation effect, such that in the exemplary embodiment a separate ratcheting mechanism or pin or other such means of selective locking particularly the take-up shaft 80 are not employed or necessary; that is, a particular tension that is dialed to in such arrangement would be held by the gear train without more, with the tension only being further adjusted up or down upon further selective movement of the drive shaft 89 as by being engaged by a key K or dial or the like in a manual embodiment or a motor or the like in an electronic or electro-mechanical embodiment. Alternatively, a ratcheting pin or other such device may still be employed even in a worm-gear-style dial assembly 70 for further functionality or "locking" of the dial assembly 70. Any such mechanism may be selectively released or adjusted in any manner now known or later developed in the art. It will again be appreciated that any and all such components of the drumhead tuning rim apparatus 20 may be formed of any suitable material, such as metal or plastic, through any suitable fabrication process, such as molding, casting, machining, stamping, or forming, whether now known or later developed.

Figure 18:
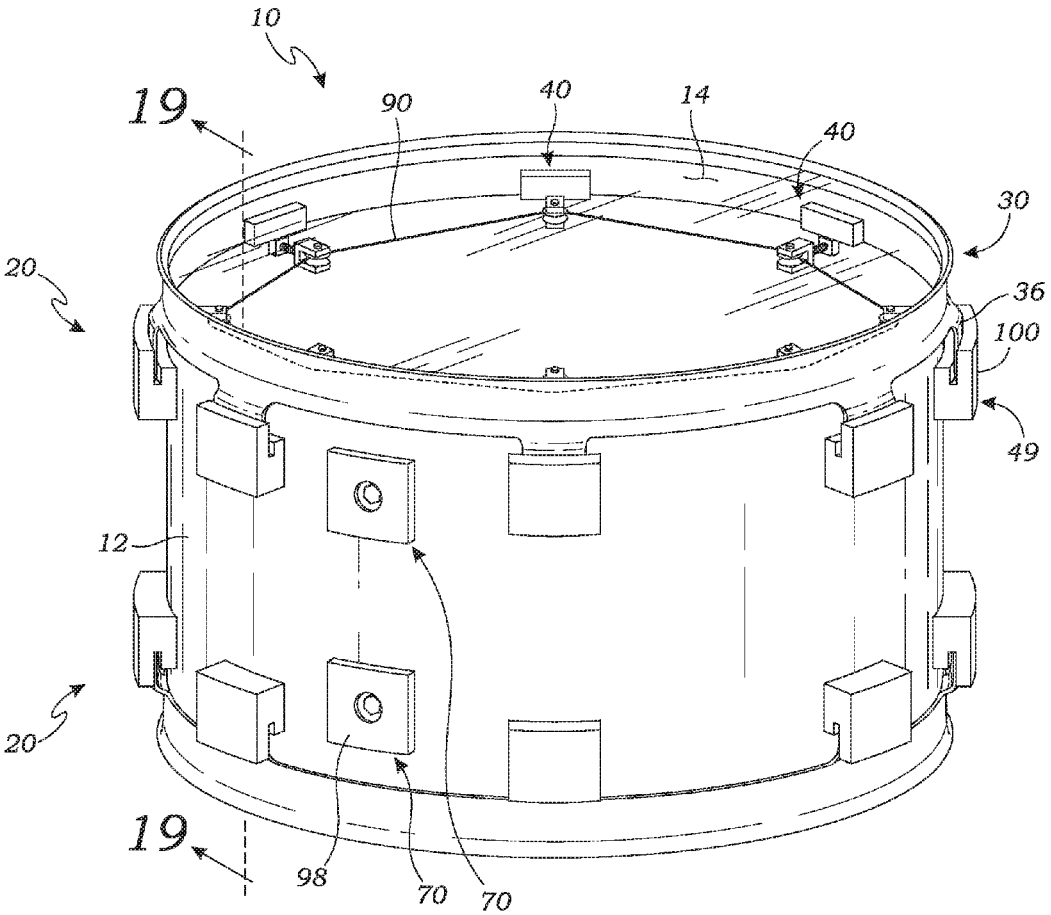
FIG. 18 is a perspective view of a still further alternative exemplary embodiment of the invention.
Figure 19:
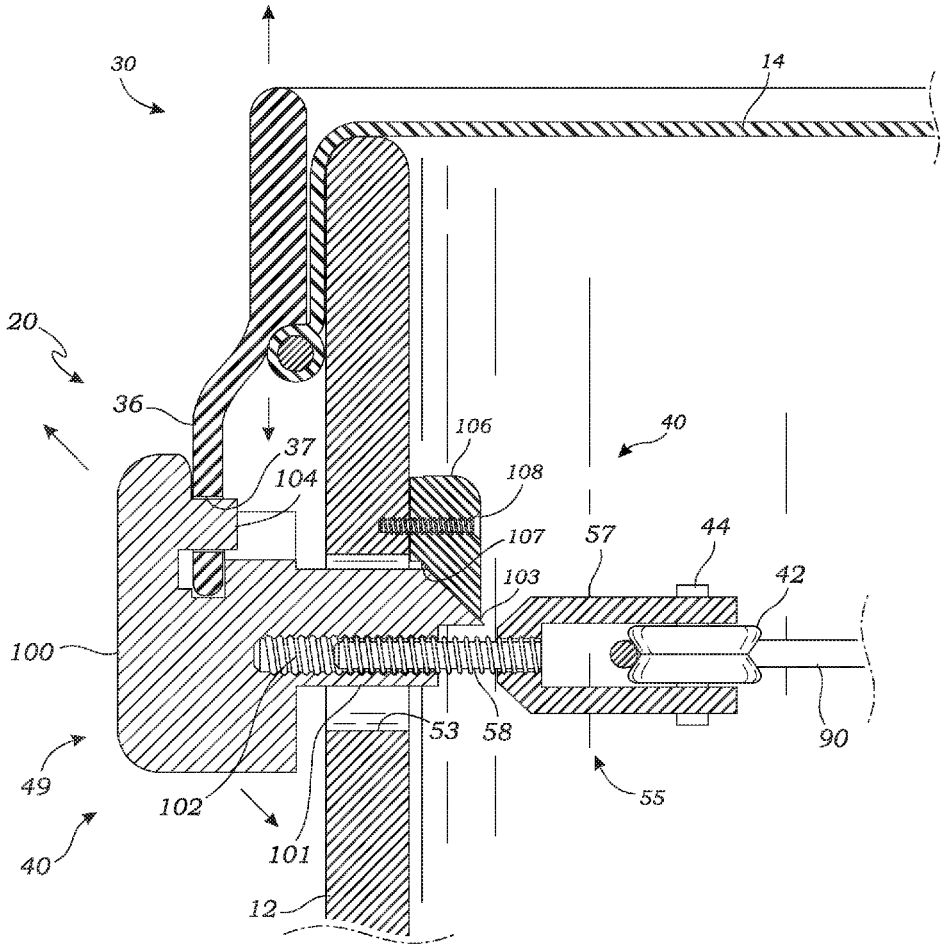
FIG. 19 is an enlarged partial cross-sectional view taken along line 19-19 of FIG. 18.

Finally, turning to FIGS. 18 and 19, there is shown yet another alternative exemplary drum 10 with drumhead tuning rim apparatus 20 according to aspects of the present invention, here again with such components primarily internalized. Somewhat analogous to the embodiment of FIGS. 15 and 16, there is again shown a substantially horizontally-oriented tensioning cable 90 within the drum 10 passing through multiple spaced apart housing assemblies 40 configured for selectively applying tension or downward force to the rim 30 so as to tighten or loosen or adjust the tuning of the drumhead 14. Here, there is such a drumhead tuning rim apparatus 20 associated with each drumhead 14, each such apparatus 20 further having its own cable tension dial assembly 70 as well so that the drumheads 14 are individually tunable, though again, such could be achieved with a single dial assembly 70. In the exemplary embodiment, each such cable tension dial assembly 70 is substantially as illustrated and described above in connection with FIG. 17, though once more it will be appreciated that a variety of such mechanisms now known or later developed may be employed according to aspects of the present invention. In that regard, it will be appreciated that by simply extending the vertical take-up shaft 80 downwardly and providing a second portion for engagement of a tensioning cable 90, one such dial assembly 70 may be configured to simultaneously control two offset heads 14. As also shown in FIG. 18, each rim 30 is again configured with spaced apart tabs 36 that here engage a housing actuator member 49 of the respective housing assembly 40 configured as an outer wedge block 100, more about which is said below in connection with FIG. 19. Here it is simply observed that while the outer wedge blocks 100 are shown as substantially square in profile or overall shape or configuration, such may instead be configured as more curved and/or as having a relatively lower profile, or as in other embodiments may be configured to substantially only engage the rim tab 36 from behind and so not have any structure radially outward of the rim tabs 36. Turning to FIG. 19, an enlarged cross-sectional view of a representative housing assembly 40 of FIG. 18, the outer wedge block 100 is shown as having a second inward protrusion 104 configured to engage an opening or receiver 37 formed in the tab 36 of the rim 30. In this manner, along with the related geometry of both the tab 36 and the outer wedge block 100, including the respective receiver 37 and protrusion 104, it will be appreciated that the outer wedge block 100 is thus positively engaged with the tab 36 so as to apply a force to the tab 36 and thus the rim 30 as the outer wedge block 100 is shifted or a force is applied to it, more about which is said below. Once again, other means of coupling the outer wedge block 100 with the tab 36 and thus of configuring the rim 30 and the outer wedge block 100, both now known and later developed, may be employed, such that the illustrated configuration of the components is to be understood as merely exemplary and non-limiting. Relatedly, in further alternate embodiments the outer wedge block 100 may be formed so as to engage the tab 36 only from the back more like the embodiments of FIGS. 13-16 or may even be formed integrally with the rim 30. Again, the particular configurations of such components are illustrative and the drawings are specifically not to be taken to scale or as representing any actual or relative sizes or proportionality of any of the components. The outer wedge block 100 is further illustrated as having a first inward protrusion 101 configured to extend radially inwardly into the drum 10 through an opening 53 formed in the shell 12. Within the first protrusion 101 there is formed a threaded hole 102 into which the housing lever arm 55 is threadably engaged as shown. Specifically, in the exemplary embodiment the housing lever arm 55 assembly includes a threaded rod 58 that engages the threaded hole 102 at one end and at an opposite end engages a bearing bracket 57 within which is rotatably installed in a substantially horizontal orientation a housing grooved bearing wheel 42 as on an axle 44. Once more, those skilled in the art will appreciate that while a bearing wheel 42 is shown, other low-friction surfaces on which the tensioning cable 90 may ride may be employed. By coupling the bearing surface 42 and thus the point at which tension is applied via the cable 90 to the outer wedge block 100 employing a threaded rod 58 it will thus be appreciated that the distance between the components and ultimately the effective diameter of the tensioning cable 90 "loop" as defined by the respective spaced apart housing assemblies 40 may be adjusted. Again, whatever the diameter of the cable 90 loop, whether as adjusted in its "at rest" configuration or as shifted during use in tuning the drumhead 14, the cable tension dial assembly 70 may be configured so as to have its effective take-up point adjustable as well so as to stay on the same radius with the other bearing surfaces 42, or once more may even be configured so as to replace one of the housing assemblies 40 spaced about the perimeter of the drum shell 12. Alternatively, the housing lever arm 55 may be formed integrally with the outer wedge block 100, thereby eliminating the separate bearing bracket 57 and threaded rod 58 and effectively mounting the bearing wheel 42 or other bearing surface within the outer wedge block 100 itself. In either case, the outer wedge block 100 is again operably coupled with the rim 30 at its outer portion and with the tensioning cable 90 at its inner portion, with the outer wedge block 100 extending from outside the drum shell 12 to inside via the shell opening 53, which it will be appreciated can be of any size or shape depending on both the geometry of the outer wedge block 100, and particularly the first protrusion 101, and the amount of travel expected in adjusting the tension on the drumhead 14 or otherwise operating the drumhead tuning rim apparatus 20, such that again all such sizes and shapes are illustrative and non-limiting. Notably, with continued reference to FIGS. 18 and 19 and specifically relating to the movement of the "floating" outer wedge blocks 100 engaged with the rim 30, there is also shown adjacent to the outer wedge block 100 and the drum shell opening 53 an inner wedge block 106 installed on the inner surface of the drum shell 12. The outer wedge block 100 is further formed on the first inward protrusion 101 with an inwardly- and upwardly-facing sloped outer ramp 103 and the inner wedge block 106 is similarly formed having an outwardly- and downwardly-facing sloped inner ramp 107. As shown and will be appreciated, the mating and offset ramps 103, 107 thus provide for mechanical coupling wherein the movable outer wedge block 100 may slide along the fixed inner wedge block 106—the outer ramp 103 engaging and riding against the inner ramp 107, such that the outer wedge block 100 may thus shift up and out or down and in. Specifically, to facilitate such selective movement of the outer wedge block 100 and thus of the rim 30, those skilled in the art will appreciate that as the tensioning cable 90 is tightened or shortened the bearing wheels 42 and thus the housing lever arm 55 will be pulled inwardly. Such movement translates to an inward force acting on the outer wedge block 100, on which basis the outer wedge block 100 is forced downwardly as the outer ramp 103 rides on the sloped inner ramp 107 of the fixed inner wedge block 106, thereby also pulling the rim 30 downwardly and putting increased tension on the drumhead 14. It will be appreciated that even relatively slight movement of the outer wedge block 100 as described may put sufficient increased tension on the drumhead 14 to tune as desired. Even so, sufficient clearance for such movement of the outer wedge block 100, and specifically the first inward protrusion 101 is provided within the shell opening 53. Moreover, to account for relatively greater and potentially somewhat inward travel of the outer wedge block 100 as it follows the downward and inward slope of the inner wedge block 106, the coupling of the outer wedge block 100 with the rim, in the exemplary embodiment as by passing the second protrusion 104 through the receiver 37 in the rim tab 36 may be configured with sufficient "play" or pivotability between components to account for such as the rim 30 shifts substantially vertically up or down. Those skilled in the art will appreciate that a variety of other such mechanical arrangements may again be employed without departing from the spirit and scope of the invention, such that the wedge configuration shown and described is to be understood as illustrative and non-limiting.

Aspects of the present specification may also be described as follows:

1. A drumhead tuning rim system for securing and tuning a drumhead on a drum shell of a drum, comprising a drumhead tuning rim apparatus comprising a cable tension dial assembly configured for operably engaging a rim of the drum so as to increase or decrease tension on the rim, the rim being configured for seating over the drumhead on the drum shell, and an apparatus controller configured for operably interfacing with the drumhead tuning rim apparatus so as to selectively control the cable tension dial assembly and thereby adjust the overall pitch of the drumhead as by adjusting the tension on the rim.

2. The system of embodiment 1 wherein the drumhead tuning rim apparatus further comprises a plurality of low friction housing assemblies configured to be installed spaced along the rim of the drum, a plurality of low friction lug assemblies configured to be installed spaced about the drum shell substantially between the respective housing assemblies, and a tensioning cable configured for alternately passing between and about respective housing and lug assemblies substantially about the perimeter of the drum shell and for operably engaging the cable tension dial assembly at opposite ends.

3. The system of embodiment 2 wherein a single row of lug assemblies are positioned about the drum shell, a single cable tension dial assembly is operably installed on the drum shell, and first and second tensioning cables are both operably engaged with the single cable tension dial assembly and with respective first and second rims each having respective housing assemblies installed thereon, whereby the single cable tension dial assembly is capable of adjusting the overall pitch of two drumheads.

4. The system of embodiment 3 wherein each lug assembly is formed having opposing grooves in which the respective first and second tensioning cables run.

5. The system of embodiment 2 wherein the housing assemblies comprise low friction bearing surfaces on which the tensioning cable runs.

6. The system of embodiment 2 wherein the housing assemblies comprise rotatable housing grooved bearing wheels on which the tensioning cable runs.

7. The system of embodiment 2 wherein the apparatus controller is selected from the group consisting of a dial and a key.

8. The system of embodiment 7 wherein the cable tension dial assembly further comprises a cable tension dial body installed on the drum shell, a shaft operable within the cable tension dial body and configured for engagement with the tensioning cable, and the dial selectively installed on the shaft for operation thereof, whereby rotation of the shaft as through operation of the dial effectively increases or decreases tension in the tensioning cable and thus raises or lowers the overall pitch of the drumhead.

9. The system of embodiment 7 wherein the cable tension dial assembly further comprises a cable tension dial body installed on the drum shell, a shaft operable within the cable tension dial body and configured for engagement with the tensioning cable, the shaft being formed with an outwardly protruding dial lug accessible through an opening formed in the dial body, and the key selectively engageable with the shaft via the dial lug for operation thereof, whereby rotation of the shaft as through operation of the key effectively increases or decreases tension in the tensioning cable and thus raises or lowers the overall pitch of the drumhead.

10. The system of embodiment 1 wherein the cable tension dial assembly further comprises a shaft and a tensioning cable operably engaging the shaft at opposite ends and mechanically coupled to the rim of the drum.

11. The system of embodiment 10 wherein the shaft is driven by a motor operably installed within the cable tension dial assembly.

12. The system of embodiment 11 further comprising an apparatus microprocessor operably engaged with the motor so as to selectively control operation thereof and thus of the shaft and tuning of the drumhead.

13. The system of embodiment 12 wherein the cable tension dial assembly further comprises an apparatus interface for selectively providing an operable interface between the apparatus microprocessor and the apparatus controller.

14. The system of embodiment 13 wherein the apparatus controller is selected from the group consisting of a control panel, a selection button, a touchpad, a touchscreen interface, a lever, a switch, a knob, a smartphone, a tablet device, and a computer.

15. The system of embodiment 13 wherein there is a wired connection between the apparatus controller and the apparatus microprocessor through the apparatus interface.

16. The system of embodiment 13 wherein there is a wireless connection between the apparatus controller and the apparatus microprocessor through the apparatus interface.

17. The system of embodiment 12 further comprising a sensor operably installed relative to the drum and operably engaged with the apparatus microprocessor so as to provide feedback to the cable tension dial assembly for adjustment of the pitch of the drumhead as desired.

18. The system of embodiment 1 further comprising a plurality of drumhead tuning rim apparatuses configured for operable engagement with a corresponding plurality of drums, a plurality of apparatus controllers operably interfacing with the plurality of drumhead tuning rim apparatuses, and a system controller having a system microprocessor operably engaged with the plurality of drumhead tuning rim apparatuses for selective control of one or more of the plurality of drumhead tuning rim apparatuses and thus selective tuning of one or more drums.

19. The system of embodiment 18 wherein the system controller directly controls the plurality of drumhead tuning rim apparatuses, such that the plurality of apparatus controllers are effectively incorporated within the system controller.

20. The system of embodiment 18 wherein the system microprocessor comprises a RAM memory storing an operating protocol.

21. The system of embodiment 18 wherein the system controller is selected from the group consisting of a control panel, a selection button, a touchpad, a touchscreen interface, a lever, a switch, a knob, a smartphone, a tablet device, and a computer.

22. The system of embodiment 18 further comprising a system interface for selective interaction with the system controller.

23. The system of embodiment 18 further comprising a plurality of sensors operably installed relative to the plurality of drums and operably engaged with the system microprocessor so as to provide feedback to the plurality of drumhead tuning rim apparatuses for adjustment of the pitch of the respective drums as desired.

24. A drumhead tuning rim system for securing and tuning a drumhead on a drum shell of a drum, comprising a drumhead tuning rim apparatus comprising a cable tension dial assembly operably engaging a rim of the drum so as to increase or decrease tension on the rim, the rim being configured for seating over the drumhead on the drum shell, the cable tension dial assembly comprising a shaft driven by a motor and mechanically engaged with the rim through a tensioning cable, and an apparatus controller operably interfacing with the drumhead tuning rim apparatus so as to selectively control the cable tension dial assembly and thereby adjust the overall pitch of the drumhead as by adjusting the tension on the rim, the apparatus controller being selected from the group consisting of a control panel, a selection button, a touchpad, a touchscreen interface, a lever, a switch, a knob, a smartphone, a tablet device, and a computer.

25. A method of securing and tuning a drumhead on a drum shell of a drum, comprising the steps of positioning the drumhead on the drum shell, positioning a rim over the drumhead, the rim being configured with a plurality of housing assemblies installed thereabout, looping a tensioning cable passing around the housing assemblies underneath corresponding lug assemblies installed about the drum shell substantially between the respective housing assemblies, and tightening the tensioning cable until the desired overall pitch of the drumhead is achieved.

26. The method of embodiment 25 wherein the step of tightening the tensioning cable comprises selectively turning a dial of a cable tension dial assembly operably engaging the rim of the drum through the tensioning cable.

27. The method of embodiment 25 wherein the step of tightening the tensioning cable comprises engaging a key with a cable tension dial assembly operably engaging the rim of the drum through the tensioning cable, and selectively turning the key.

28. The method of embodiment 25 wherein the step of tightening the tensioning cable comprises selectively operating a motor operably engaged with a cable tension dial assembly operably engaging the rim of the drum through the tensioning cable.

29. The method of embodiment 28 wherein the step of selectively operating the motor comprises interacting with the motor through one of a control panel, a selection button, a touchpad, a touchscreen interface, a lever, a switch, a knob, a smartphone, a tablet device, and a computer.

30. The method of embodiment 25 wherein multiple drums are to be tuned, comprising the further steps of positioning a plurality of drumheads on a plurality of drum shells, positioning a plurality of rims over the respective drumheads, the rims each being configured with a plurality of housing assemblies installed thereabout, on each drum looping a tensioning cable passing around the housing assemblies underneath corresponding lug assemblies installed about the respective drum shells substantially between the respective housing assemblies, and selectively operating a system controller to selectively tighten one or more of the tensioning cables until the desired overall pitch of one or more of the drumheads is achieved.

31. The system of embodiment 1 wherein the drumhead tuning rim apparatus further comprises a plurality of low friction housing assemblies configured to be installed spaced along the rim of the drum, and a tensioning cable configured for passing between adjacent housing assemblies substantially about the perimeter of the drum shell and for operably engaging the cable tension dial assembly at opposite ends.

32. The system of embodiment 31 wherein the rim comprises a plurality of tabs corresponding to the plurality of low friction housing assemblies, each tab being configured with a receiver, and each low friction housing assembly comprises a housing actuator member configured to selectively engage the receiver so as to couple the low friction housing assembly to the rim.

33. The system of embodiment 32 wherein each low friction housing assembly is installed within the drum shell and the housing actuator member passes through an opening in the drum shell so as to engage the receiver.

34. The system of embodiment 33 wherein each low friction housing assembly further comprises a housing lever arm formed integrally with the housing actuator member so as to extend at an angle therefrom, the housing actuator member and the housing lever arm together being pivotally installed on a housing pivot post, whereby the tensioning cable acts on the housing lever arm under the control of the cable tension dial assembly to selectively pivot the housing actuator member to adjust the tension on the rim.

35. The system of embodiment 33 wherein the housing actuator member is formed as an outer wedge block having an outer ramp configured to slidably engage an inner ramp formed on an inner wedge block installed within the drum shell adjacent to the opening.

36. The system of embodiment 35 wherein the housing actuator member is coupled to the tensioning cable, whereby the tensioning cable acts on the outer wedge block under the control of the cable tension dial assembly to selectively slide the outer ramp of the outer wedge block along the inner ramp of the inner wedge block to adjust the tension on the rim.

37. The system of embodiment 36 wherein each low friction housing assembly further comprises a housing lever arm coupled with the housing actuator arm, the housing lever arm having a substantially horizontally oriented housing grooved bearing wheel operably installed within a bearing bracket thereof, whereby the tensioning cable operably engages the housing grooved bearing wheel so as to selectively shift the outer wedge block.

38. The system of embodiment 31 wherein the tensioning cable is configured as a substantially horizontal loop.

39. The system of embodiment 2 wherein the rim comprises a plurality of tabs corresponding to the plurality of low friction housing assemblies, each tab being configured with a receiver, and each low friction housing assembly comprises a housing actuator member configured to selectively engage the receiver so as to couple the low friction housing assembly to the rim.

40. The system of embodiment 39 wherein each low friction housing assembly and each low friction lug assembly is installed within the drum shell and the housing actuator member passes through an opening in the drum shell so as to engage the receiver.

41. The system of embodiment 40 wherein each low friction housing assembly further comprises a housing base slidably installed within a housing base plate mounted within the drum shell adjacent to the opening, the housing actuator member extending from the housing base through the opening.

42. The system of embodiment 2 wherein each low friction lug assembly is installed within the drum shell, the tensioning cable passing from each low friction lug assembly to the respective low friction housing assembly through an eye-hole formed within the drum shell.

43. The system of embodiment 1 wherein the cable tension dial assembly further comprises at least one shaft, and a tensioning cable operably engaging the shaft at opposite ends and mechanically coupled to the rim of the drum.

44. The system of embodiment 43 wherein the cable tension dial assembly is installed within the drum shell adjacent to an opening in the drum shell providing the apparatus controller with access to the cable tension dial assembly.

45. The system of embodiment 43 wherein the at least one shaft of the cable tension dial assembly comprises a drive shaft configured as a worm gear and with a dial lug for selective engagement by the apparatus controller, the drive shaft being oriented substantially horizontally, and a take-up shaft oriented substantially vertically so as to be perpendicular to the drive shaft and having a gear configured for engagement with the drive shaft, whereby rotation of the drive shaft via the apparatus controller causes rotation of the take-up shaft and selective tightening or loosening of the tensioning cable engaged with the take-up shaft.

46. A drumhead tuning rim system for securing and tuning a drumhead on a drum shell of a drum, comprising: a drumhead tuning rim apparatus comprising a cable tension dial assembly configured for operably engaging a rim of the drum so as to increase or decrease tension on the rim, the rim being configured for seating over the drumhead on the drum shell, the drumhead tuning rim apparatus further comprising a plurality of low friction housing assemblies configured to be installed spaced along the rim of the drum and a tensioning cable configured for passing between adjacent housing assemblies substantially about the perimeter of the drum shell and for operably engaging the cable tension dial assembly at opposite ends, the rim comprising a plurality of tabs corresponding to the plurality of low friction housing assemblies, each tab being configured with a receiver, and each low friction housing assembly comprising a housing actuator member configured to selectively engage the receiver so as to couple the low friction housing assembly to the rim; and an apparatus controller configured for operably interfacing with the drumhead tuning rim apparatus so as to selectively control the cable tension dial assembly and thereby adjust the overall pitch of the drumhead as by adjusting the tension on the rim.

47. A drumhead tuning rim system for securing and tuning a drumhead on a drum shell of a drum, comprising: a drumhead tuning rim apparatus comprising: a plurality of low friction housing assemblies configured to be installed within the drum shell spaced along a rim of the drum, the rim comprising a plurality of tabs corresponding to the plurality of low friction housing assemblies, each tab being configured with a receiver and each low friction housing assembly comprising a housing actuator member configured to pass through a housing opening in the drum shell to selectively engage the receiver so as to couple the low friction housing assembly to the rim; a cable tension dial assembly installed within the drum shell adjacent to a dial opening in the drum shell; and a tensioning cable configured for passing between adjacent housing assemblies within the drum shell and for operably engaging the cable tension dial assembly at opposite ends so as to increase or decrease tension on the rim, the rim being configured for seating over the drumhead on the drum shell; and an apparatus controller configured for operably interfacing with the drumhead tuning rim apparatus so as to selectively control the cable tension dial assembly and thereby adjust the overall pitch of the drumhead as by adjusting the tension on the rim.

To summarize, regarding the exemplary embodiments of the present invention as shown and described herein, it will be appreciated that a drumhead tuning rim system and method is disclosed and configured for drumhead mounting and tuning to replace the standard six, eight, or twelve lug and tension rod system that is currently used on most traditional drum kit snares, toms, and bass drums. Because the principles of the invention may be practiced in a number of configurations beyond those shown and described, it is to be understood that the invention is not in any way limited by the exemplary embodiments, but is generally directed to a drumhead tuning rim system and method and is able to take numerous forms to do so without departing from the spirit and scope of the invention. Furthermore, the various features of each of the above-described embodiments may be combined in any logical manner and are intended to be included within the scope of the present invention.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

The terms "a," "an," "the" and similar referents used in the context of describing the present invention (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

Specific embodiments disclosed herein may be further limited in the claims using "consisting of" or "consisting essentially of" language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the present invention so claimed are inherently or expressly described and enabled herein.

It should be understood that the logic code, programs, modules, processes, methods, and the order in which the respective elements of each method are performed are purely exemplary. Depending on the implementation, they may be performed in any order or in parallel, unless indicated otherwise in the present disclosure. Further, the logic code is not related, or limited to any particular programming language, and may comprise one or more modules that execute on one or more processors in a distributed, non-distributed, or multiprocessing environment.

The methods as described above may be used in the fabrication of integrated circuit chips. The resulting integrated circuit chips can be distributed by the fabricator in raw wafer form (that is, as a single wafer that has multiple unpackaged chips), as a bare die, or in a packaged form. In the latter case, the chip is mounted in a single chip package (such as a plastic carrier, with leads that are affixed to a motherboard or other higher level carrier) or in a multi-chip package (such as a ceramic carrier that has either or both surface interconnections or buried interconnections). In any case, the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. A drumhead tuning rim system for securing and tuning a drumhead on a drum shell of a drum, comprising:

a drumhead tuning rim apparatus comprising a cable tension dial assembly installed within the drum shell adjacent to an opening in the drum shell providing access to the cable tension dial assembly therein, wherein the cable tension dial assembly comprises:

at least one shaft; and a tensioning cable operably engaging the at least one shaft and mechanically coupled to a rim of the drum.

2. The system of claim 1 wherein the drumhead tuning rim apparatus further comprises:

a plurality of low friction housing assemblies configured to be installed spaced along the rim of the drum; and wherein:

the tensioning cable passes between adjacent housing assemblies substantially about the perimeter of the drum shell.

3. The system of claim 2 wherein:

the rim comprises a plurality of tabs corresponding to the plurality of low friction housing assemblies, each tab being configured with a receiver; and each low friction housing assembly comprises a housing actuator member configured to selectively engage the receiver so as to couple the low friction housing assembly to the rim.

4. The system of claim 3 wherein each low friction housing assembly is installed within the drum shell and the housing actuator member passes through an opening in the drum shell so as to engage the receiver.

5. The system of claim 4 wherein each low friction housing assembly further comprises a housing lever arm formed integrally with the housing actuator member so as to extend at an angle therefrom, the housing actuator member and the housing lever arm together being pivotally installed on a housing pivot post, whereby the tensioning cable acts on the housing lever arm under the control of the cable tension dial assembly to selectively pivot the housing actuator member to adjust the tension on the rim.

6. The system of claim 4 wherein the housing actuator member is formed as an outer wedge block having an outer ramp configured to slidably engage an inner ramp formed on an inner wedge block installed within the drum shell adjacent to the opening.

7. The system of claim 6 wherein the housing actuator member is coupled to the tensioning cable, whereby the tensioning cable acts on the outer wedge block under the control of the cable tension dial assembly to selectively slide the outer ramp of the outer wedge block along the inner ramp of the inner wedge block to adjust the tension on the rim.

8. The system of claim 7 wherein each low friction housing assembly further comprises a housing lever arm coupled with the housing actuator arm, the housing lever arm having a substantially horizontally oriented housing grooved bearing wheel operably installed within a bearing bracket thereof, whereby the tensioning cable operably engages the housing grooved bearing wheel so as to selectively shift the outer wedge block.

9. The system of claim 2 wherein the tensioning cable is configured as a substantially horizontal loop.

10. The system of claim 1 wherein the drumhead tuning rim apparatus further comprises:

a plurality of low friction housing assemblies configured to be installed spaced along the rim of the drum; and a plurality of low friction lug assemblies configured to be installed spaced about the drum shell; and wherein:

the tensioning cable passes between and about respective housing and lug assemblies substantially about the perimeter of the drum shell.

11. The system of claim 10 wherein:

the rim comprises a plurality of tabs corresponding to the plurality of low friction housing assemblies, each tab being configured with a receiver; and each low friction housing assembly comprises a housing actuator member configured to selectively engage the receiver so as to couple the low friction housing assembly to the rim.

12. The system of claim 11 wherein each low friction housing assembly and each low friction lug assembly is installed within the drum shell and the housing actuator member passes through an opening in the drum shell so as to engage the receiver.

13. The system of claim 12 wherein each low friction housing assembly further comprises a housing base slidably installed within a housing base plate mounted within the drum shell adjacent to the opening, the housing actuator member extending from the housing base through the opening.

14. The system of claim 10 wherein each low friction lug assembly is installed within the drum shell, the tensioning cable passing from each low friction lug assembly to the respective low friction housing assembly through an eyehole formed within the drum shell.

15. The system of claim 1 wherein the at least one shaft of the cable tension dial assembly comprises:

a drive shaft configured as a worm gear; and a take-up shaft having a gear configured for engagement with the drive shaft, whereby rotation of the drive shaft causes rotation of the take-up shaft and selective tightening or loosening of the tensioning cable engaged with the take-up shaft.

16. A drumhead tuning rim system for securing and tuning a drumhead on a drum shell of a drum, comprising:

a drumhead tuning rim apparatus comprising a cable tension dial assembly, the drumhead tuning rim apparatus further comprising a plurality of low friction housing assemblies configured to be installed spaced along the rim of the drum and a tensioning cable configured for passing between adjacent housing assemblies substantially about the perimeter of the drum shell, the rim comprising a plurality of tabs corresponding to the plurality of low friction housing assemblies, each tab being configured with a receiver, and each low friction housing assembly comprising a housing actuator member configured to selectively engage the receiver so as to couple the low friction housing assembly to a rim of the drum.

17. A drumhead tuning rim system for securing and tuning a drumhead on a drum shell of a drum, comprising:

a drumhead tuning rim apparatus comprising a cable tension dial assembly; wherein the cable tension dial assembly comprises:

a worm gear-style drive shaft; and a take-up shaft having a gear configured for engagement with the drive shaft, whereby rotation of the drive shaft causes rotation of the take-up shaft and selective tightening or loosening of a tensioning cable engaged with the take-up shaft and with a rim of the drum.

* * * * *